US012264837B2

(12) United States Patent
Kim et al.

(10) Patent No.: US 12,264,837 B2
(45) Date of Patent: Apr. 1, 2025

(54) HYGIENE MANAGEMENT DEVICE FOR ENTRANCE HALL

(71) Applicant: LG ELECTRONICS INC., Seoul (KR)

(72) Inventors: Taihong Kim, Seoul (KR); Hyunbyung Cha, Seoul (KR); Hyunsun Yoo, Seoul (KR); Joohyeon Oh, Seoul (KR); Byoungjoonphilip Han, Seoul (KR); Sang Yoon Lee, Seoul (KR); HyunJu Kim, Seoul (KR); Chul Bae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 470 days.

(21) Appl. No.: 17/550,614

(22) Filed: Dec. 14, 2021

(65) Prior Publication Data

US 2022/0186971 A1 Jun. 16, 2022

(30) Foreign Application Priority Data

Dec. 14, 2020 (KR) ..... 10-2020-0174512
Feb. 4, 2021 (KR) ..... 10-2021-0015902

(51) Int. Cl.

| | |
|---|---|
| ***F24F 11/79*** | (2018.01) |
| ***F24F 9/00*** | (2006.01) |
| ***F24F 13/072*** | (2006.01) |
| ***F24F 13/14*** | (2006.01) |

(52) U.S. Cl.

CPC ..... *F24F 11/79* (2018.01); *F24F 9/00* (2013.01); *F24F 13/072* (2013.01); *F24F 13/1413* (2013.01); *F24F 13/1426* (2013.01); *F24F 2013/1433* (2013.01)

(58) Field of Classification Search

CPC ..... F24F 9/00; F24F 11/79; F24F 13/1413; F24F 13/081
USPC ..... 454/284
See application file for complete search history.

(56) References Cited

U.S. PATENT DOCUMENTS

| | | | | |
|---|---|---|---|---|
| 3,049,984 A * | 8/1962 | Boysen | F24F 13/1486 | 454/192 |
| 3,068,775 A * | 12/1962 | Zehnder | F24F 9/00 | 454/192 |
| 6,290,266 B1 * | 9/2001 | Kawano | F16L 43/001 | 285/125.1 |
| 2001/0013404 A1 | 8/2001 | Lagace et al. | | |

FOREIGN PATENT DOCUMENTS

| | | |
|---|---|---|
| CN | 101497054 A | 8/2009 |
| CN | 101961677 A | 2/2011 |
| CN | 102589105 A | 7/2012 |

(Continued)

*Primary Examiner* — Allen R. B. Schult
(74) *Attorney, Agent, or Firm* — Birch, Stewart, Kolasch & Birch, LLP

(57) ABSTRACT

A hygiene management device for an entrance space is proposed. In the hygiene management device, an air discharger for discharging air toward the bottom of an entrance space operates within a predetermined angle range in an entering/exiting direction of a person, and air to be discharged through a discharge hole of the air discharger is guided to an air guide unit. A plurality of vanes are installed in a row in the air guide unit to control the direction of the air to be discharged through the discharge hole.

16 Claims, 16 Drawing Sheets

(56) References Cited

FOREIGN PATENT DOCUMENTS

| | | | | |
|---|---|---|---|---|
| CN | 203648916 | U | | 6/2014 |
| CN | 104259138 | A | | 1/2015 |
| CN | 105258316 | A | | 1/2016 |
| CN | 106765600 | A | | 5/2017 |
| CN | 111811102 | A | * | 10/2020 |
| KR | 10-2009-0040630 | A | | 4/2009 |
| KR | 20-2018-0003369 | U | | 12/2018 |
| KR | 10-2019-0055303 | A | | 5/2019 |
| KR | 10-2020-0046715 | A | | 5/2020 |

* cited by examiner (a)

(b)

(a)

(b)

HYGIENE MANAGEMENT DEVICE FOR ENTRANCE HALL

CROSS REFERENCE TO RELATED APPLICATIONS

This application claims the priority benefit of Korean Patent Application No. 10-2020-0174512, filed on Dec. 14, 2020 in the Republic of Korea and Korean Patent Application No. 10-2021-0015902, filed on Feb. 4, 2021 in the Republic of Korea, which are hereby incorporated by reference in their entirety for all purposes as if fully set forth herein.

BACKGROUND OF THE INVENTION

1. Field of the Invention

The present disclosure relates to a hygiene management device which manages the hygiene of a person entering and exiting an entrance hall.

2. Description of the Background Art

Generally, there is an entrance hall for connecting the outside with a specific indoor space, and a space, such as a vestibule, in which the entrance hall exists, which is required to be passed through to enter a specific indoor space. To enter an indoor space, a person is required to pass through the vestibule which is an entrance space, and to prevent the indoor space from being contaminated, it is required to remove contaminants in the vestibule or outside of the vestibule. When the work of removing contaminants is performed in an outdoor area, the outdoor area is contaminated, which contaminates the surrounding area or people therein. Accordingly, it is preferable to deal with the decontamination of a person in the vestibule (i.e., to decontaminate a person/people within the vestibule).

There is an air curtain which prevents contaminants from being introduced into an indoor space. This air curtain blocks external air, but during the entering/exiting of a person, the external air may be introduced into an internal space.

To solve such a problem, an air shower for a vestibule of a house is disclosed in (Patent Document 1) Korean Patent Application Publication No. 10-2009-0040630. In the related art disclosed in (Patent Document 1), air is showered on a person to remove contaminants, such as dust, on the clothing of the person. Although the discharged air removes contaminants on the person while flowing downward from an upper portion of the person, the air applied to the person flows downward from the upper portion, so the air is applied mainly to the person's head and to the upper portion of the person (i.e., the person's upper body) and thus contaminants on the person's lower body and shoes are not properly removed. Furthermore, in the vestibule, an air introduction hole into which air is introduced is located at the side surface of a vestibule space, so contaminants, such as dust, remain on the bottom of the vestibule, and during the entering/exiting of the person, external contaminants are introduced into the vestibule.

In a lighting-integrated air cleaning system, for entrance space and a control method of the same disclosed in (Patent Document 2) Korean Patent Application Publication No. 10-2020-0046715, a lighting fixture and an air cleaning system, are integrated with each other such that contaminants are removed from a person in an entrance space, such as a vestibule. However, even in the related art disclosed in Patent Document 2, structure in which air is simply discharged downward from an upper side is integrated with the light fixture, and an air introduction hole is formed in the side surface of the entrance space, so contaminants in the entrance space are not properly removed. Even in the related art, during the entering/exiting of a person, external contaminants are introduced into the vestibule.

In an air shower apparatus integrated with a vestibule door disclosed in (Patent Document 3) Korean Patent Application Publication No. 10-2019-0055303, a shower booth having a predetermined shower space there-inside is separately installed, such that a person can remove contaminants in the shower booth. However, the shower booth is separately partitioned in a space inside a vestibule, and thus a space occupied by an entire device inside the vestibule increases, so the air shower apparatus is not effective. Furthermore, the air shower apparatus has a simple structure in which air is discharged downward from an upper side, so ability with which the air shower apparatus removes contaminants decreases.

In most of such related arts, a structure in which air is simply discharged from the upper portion of the entrance space to a lower portion thereof is used, which spoils a person's hairstyle, and further, air is not transferred directly to the lower body of a person, which results in relatively poor operating performance.

DOCUMENTS OF RELATED ART (Patent Document 1) Korean Patent Application Publication No. 10-2009-004060

(Patent Document 2) Korean Patent Application Publication No. 10-2020-0046715

(Patent Document 3) Korean Patent Application Publication No. 10-2019-0055303

SUMMARY OF THE INVENTION

Accordingly, the present disclosure has been made keeping in mind the above problems occurring in the related art, and the present disclosure is intended to propose a hygiene management device for an entrance hall which discharges air such that the air flows in various directions downward from the upper portion of a person.

The present disclosure is intended to propose a hygiene management device for an entrance hall which may control the discharge of air within a predetermined angle range in the opposite side directions of a person.

The present disclosure is intended to propose a hygiene management device for an entrance hall which may control the discharge of air within a predetermined angle range in an entering/exiting direction of a person (i.e., the direction in which a person enters or exits the hygiene management device).

The present disclosure is intended to propose a hygiene management device for an entrance hall in which the amount of air discharged through discharge holes is even.

The present disclosure is intended to propose a hygiene management device for an entrance hall in which the amount of air flowing in each of the discharge holes is even in the entire portion of the discharge hole.

A hygiene management device for an entrance hall of the present disclosure may include an air discharger configured to discharge air in various directions downward from an upper portion in an entrance space.

The hygiene management device of the present disclosure may be provided with an air guide unit guiding air transferred to the discharge hole of the air discharger through a duct such that air is discharged from the discharge hole in the opposite side directions of a person within a predetermined angle range.

In the hygiene management device of the present disclosure, the air discharger provided with the air guide unit may discharge air in an entering/exiting direction of a person within a predetermined angle range by a first lift and a second lift.

In the hygiene management device of the present disclosure, the vanes of the air guide unit provided in the upstream portion of the duct and the vanes of the air guide unit provided in the downstream portion of the duct may be located at different positions such that the amount of air discharged through each discharge hole is even.

In the hygiene management device of the present disclosure, multiple vanes may be disposed in a row in the air guide unit such that air is evenly discharged in the entire area of the inside of the discharge hole.

In the hygiene management device of the present disclosure, the air guide unit may include a vane frame communicating the duct with the discharge hole, multiple vanes installed side by side in the vane frame such that the vanes are rotatable at predetermined angles and configured to guide air, and a vane motor configured to supply a driving force to the vanes for driving the vanes.

In the hygiene management device of the present disclosure, the air guide unit may further include a vane drive member connected to the multiple vanes so as to rotate the vanes at predetermined angles, and a drive link configured to operate the vane drive member by the driving force of the vane motor.

In the hygiene management device of the present disclosure, the vane drive member and the drive link may be connected to each other by a connection pin passing through a moving slot formed in the vane frame.

In the hygiene management device of the present disclosure, a rotating roll may be mounted rotatably to the connection pin to be concentric thereto such that the connection pin can move in the moving slot.

In the hygiene management device of the present disclosure, the vane may be composed of the upper flow part starting to guide air, the lower flow part configured to discharge the guided air, and a connection curved part connecting the upper flow part with the lower flow part. The start part of the upper flow part may protrude more to the inside of the duct gradually toward the downstream portion of the duct.

In the hygiene management device of the present disclosure, the duct may include a first duct extending along the wall surface of the entrance space, and a second duct extending along the ceiling of the entrance space. A first outlet may be formed in the relatively upstream portion of the second duct, and a second outlet may be formed in the relatively downstream portion of the second duct.

In the hygiene management device of the present disclosure, a corrugated pipe may be installed at each of a position between the first outlet and the vane frame and a position between the second outlet and the vane frame.

In the hygiene management device of the present disclosure, a discharger frame may constitute the frame of the air discharger, and each of a first lift and a second lift having a first side connected to the duct or the ceiling of the entrance space and having a second side connected to the discharger frame may be mounted to the opposite sides of the discharger frame. Accordingly, the operation angle of the air discharger may be set by the first and second lifts.

In the hygiene management device of the present disclosure, a relatively rotatable connection link or universal joint may be provided between the discharger frame and the duct or between the discharger frame and the ceiling of the entrance space.

The hygiene management device of the present disclosure may include a fan assembly configured to generate the flow of air, a duct constituting the path of the air flow generated by the operation of the fan assembly, and the air discharger configured to be angle-adjustable co discharge air through the discharge hole within a predetermined angle range in an entering/exiting direction of a person in the entrance space, the air discharger being provided with the air guide unit configured to guide the air to be discharged through the discharge hole to a side of the person. In the air guide unit, multiple vanes mounted to the vane frame communicating the duct with the discharge hole may be driven by the vane motor so as to be angle-adjustable.

In the hygiene management device of the present disclosure, multiple vanes may be installed at predetermined intervals in a row from the upstream, portion of the duct toward the downstream portion thereof in the vane frame.

In the hygiene management device of the present disclosure, the vane may include the upper flow part starting to guide air, the lower flow part configured to discharge the guided air, and the connection curved part connecting the upper flow part with the lower flow part.

In the hygiene management device of the present disclosure, the upper flow part of the vane may extend to be inclined toward the upstream portion of the duct inside the duct, and the lower flow part of the vane may extend to be inclined toward the center portion of the bottom of the entrance space.

In the hygiene management device of the present disclosure, the start part of the upper flow part may protrude more to the inside of the duct gradually toward the downstream portion of the duct.

In the hygiene management device of the present disclosure, as for a length between the start point of the upper flow part of the vane and the end point of the lower flow part of the vane, a vane installed in the downstream portion of the duct may be configured to be longer than a vane installed in the upstream portion of the duct.

In the hygiene management device of the present disclosure, the virtual extension surfaces of the upper and lower flow parts of the vane may be parallel to each other. The virtual extension surfaces of the upper and lower flow parts of the vane may form an obtuse angle therebetween.

In the hygiene management device of the present disclosure, the corrugated pipe may be installed between the duct and the vane frame so as to prevent the leakage of air.

The hygiene management device for an entrance hall of the present disclosure may have at least one of the following effects.

In the hygiene management device of the present disclosure, the air discharger may discharge air in various directions downward from the upper portion of a person located in the entrance space, thereby removing foreign matter such as dust on the clothing of the person. Particularly, the direction of the discharge hole of the air discharger may be preset within a predetermined angle range in the entering/exiting direction of person, thereby performing hygiene management according to various situations.

Particularly, in the hygiene management device of the present disclosure, while adjusting an angle, the air discharger may discharge air to the lower portion of the entrance space within a predetermined angle range in an entering/exiting direction of a person and simultaneously, the air guide unit may discharge air within a predetermined angle range toward the side of the person, thereby discharging air in various directions downward from the upper portion of the person and performing hygiene management.

In the hygiene management device of the present disclosure, the upper flow part of the vane located in the relatively downstream portion may protrude more to the inside of the duct than the vane located in the relatively upstream portion of the duct. According to such a structure, the amount of air flowing through the discharge hole located in the upstream portion of the duct may be the same as the amount of air flowing through the discharge hole located in the downstream portion thereof, thereby making the amount of air discharged toward the person in various directions the same.

In the hygiene management device of the present disclosure, when air transferred through the duct is discharged through the discharge hole, multiple vanes for each discharge hole may be disposed in a row sequentially toward the downstream portion of the duct from the upstream portion thereof. According to such a structure, the flow of air discharged through the discharge hole may be constant in the entirety of the discharge hole.

In the hygiene management device of the present disclosure, to rotate the vanes at predetermined angles, the drive link and the vane drive member may be connected to each other by the connection pin, and according to such a structure, the multiple vanes may be simultaneously rotated by the driving force of the vane motor, thereby setting the discharge directions of air to be constant in the entirety of the discharge hole.

In the hygiene management device of the present disclosure, the rotating roll may be mounted to the connection pin, so the connection pin may more efficiently move inside the moving slot due to the rotation of the rotating roll. Accordingly, the angle adjustment operation of the vane may be performed more easily.

In the hygiene management device of the present disclosure, the vane may be composed of the upper flow part, the connection curved part, and the lower flow part, and the upper flow part may protrude to be inclined toward the upstream portion of the duct so as to efficiently receive air flowing through the duct, and the lower flow part may be formed to be inclined toward the center of the bottom of the entrance space, thereby facilitating the discharge of air through the discharge hole.

In the hygiene management device of the present disclosure, the duct and the vane frame may be connected to each other by the corrugated pipe. Accordingly, although the vane frame and the discharger frame operate together, the leakage of air through a position between the duct and the vane frame may be prevented, thereby more efficiently discharging air by the air discharger.

In the hygiene management device of the present disclosure, the first lift and the second lift may be used to adjust the heights of the opposite edges of the discharger frame such that the operation angle of the air discharger can be preset. Accordingly, the angle of the air discharger may be adjusted easily, thereby varying the direction of discharged air.

In the hygiene management device of the present disclosure, when the connection link or the universal joint is used, the air discharger may be more securely supported on the ceiling of the entrance space or the lower surface of the duct, thereby stably performing the operation of the air discharger.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 16:
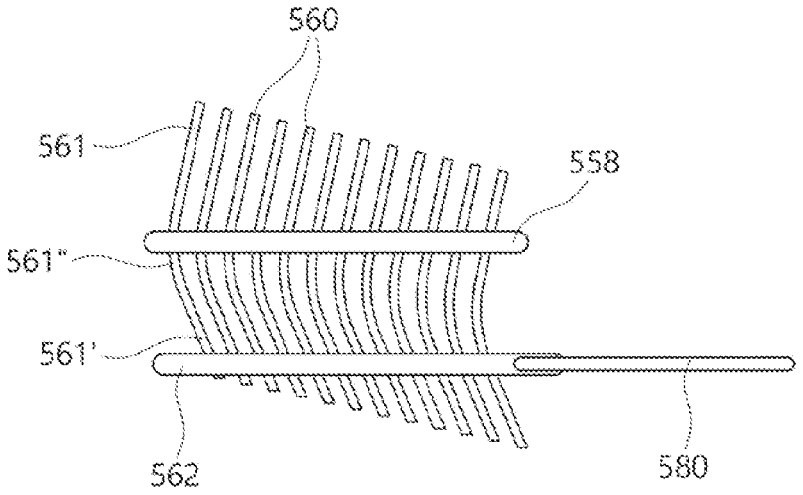
Figure 16:
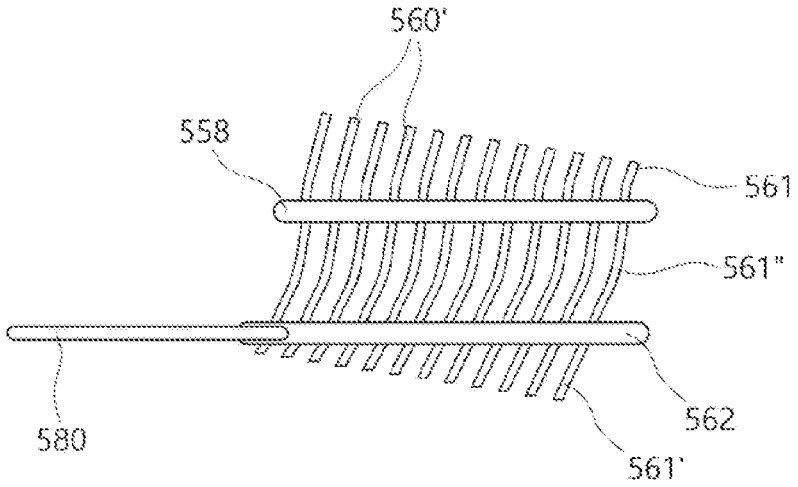

(a) of FIG. 16 is a side view illustrating the configuration of a first side air guide unit, and (b) of FIG. 16 is a side view illustrating the configuration of a second side air guide unit.

Figure 17:
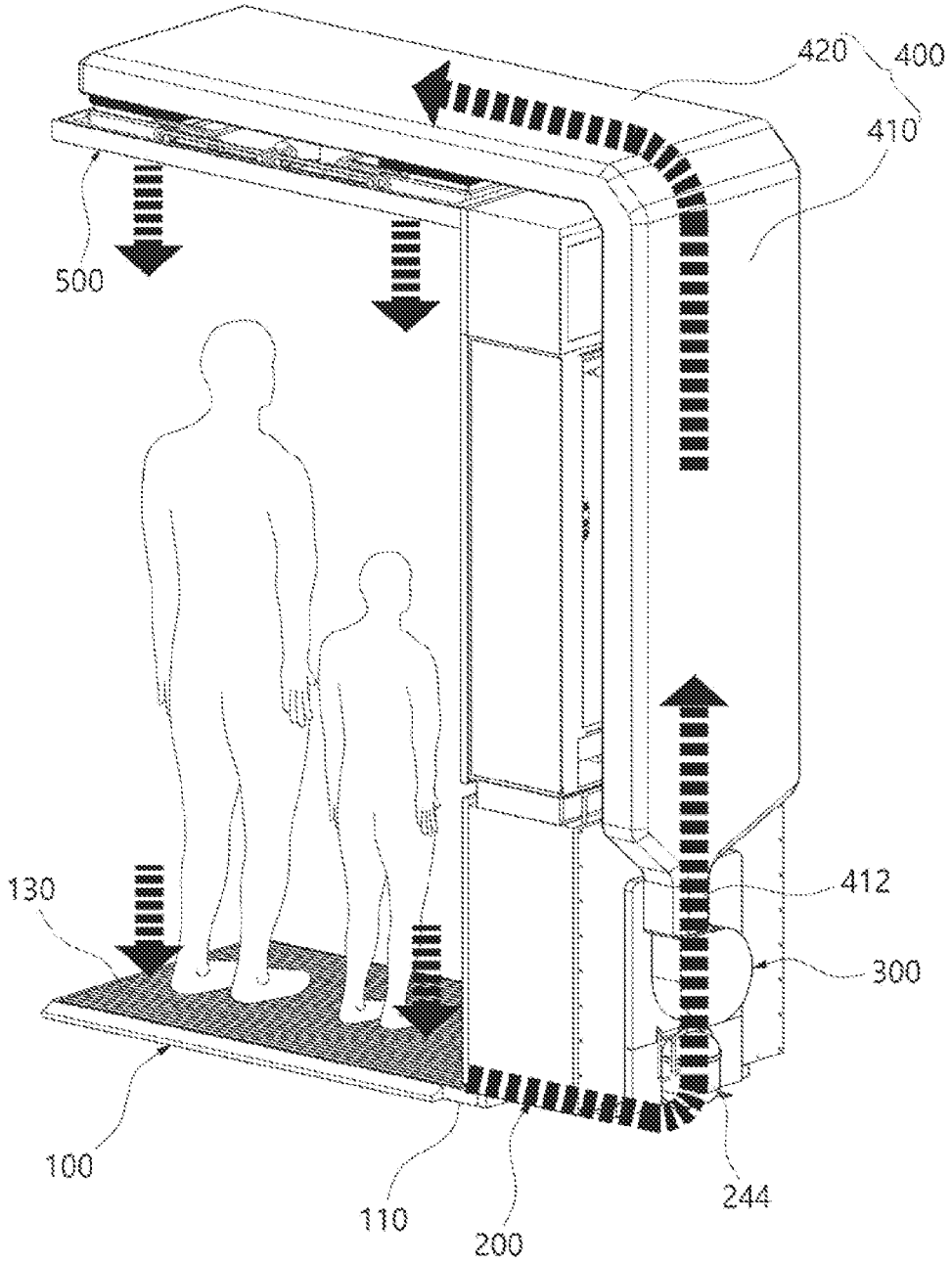

FIG. 17 is a view illustrating a state in which the hygiene management device is operating while a user is located on the footrest according to an embodiment of the present invention.

Figure 18:
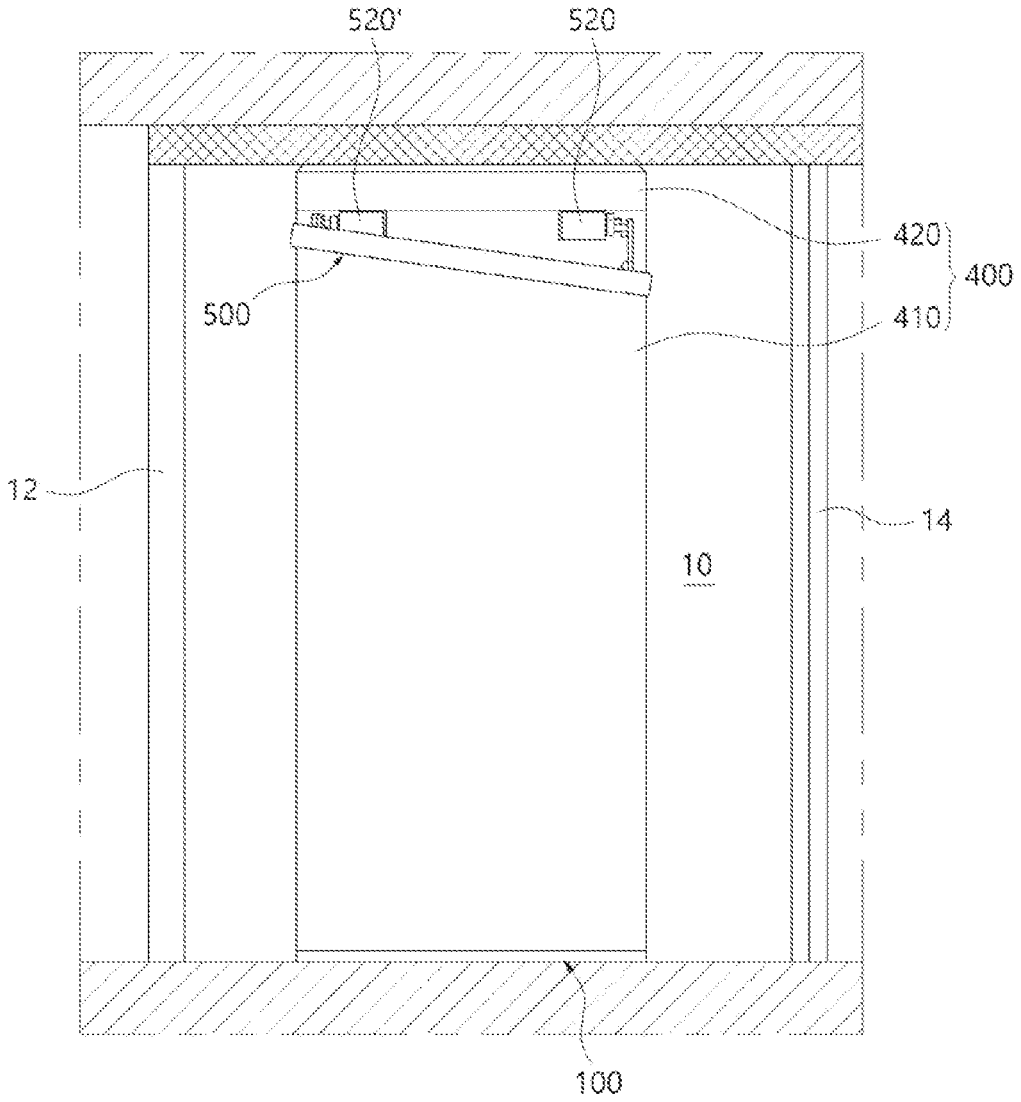

FIG. 18 is a view illustrating a state in which the air discharger is inclined toward an outside door according to an embodiment of the present invention.

Figure 19:
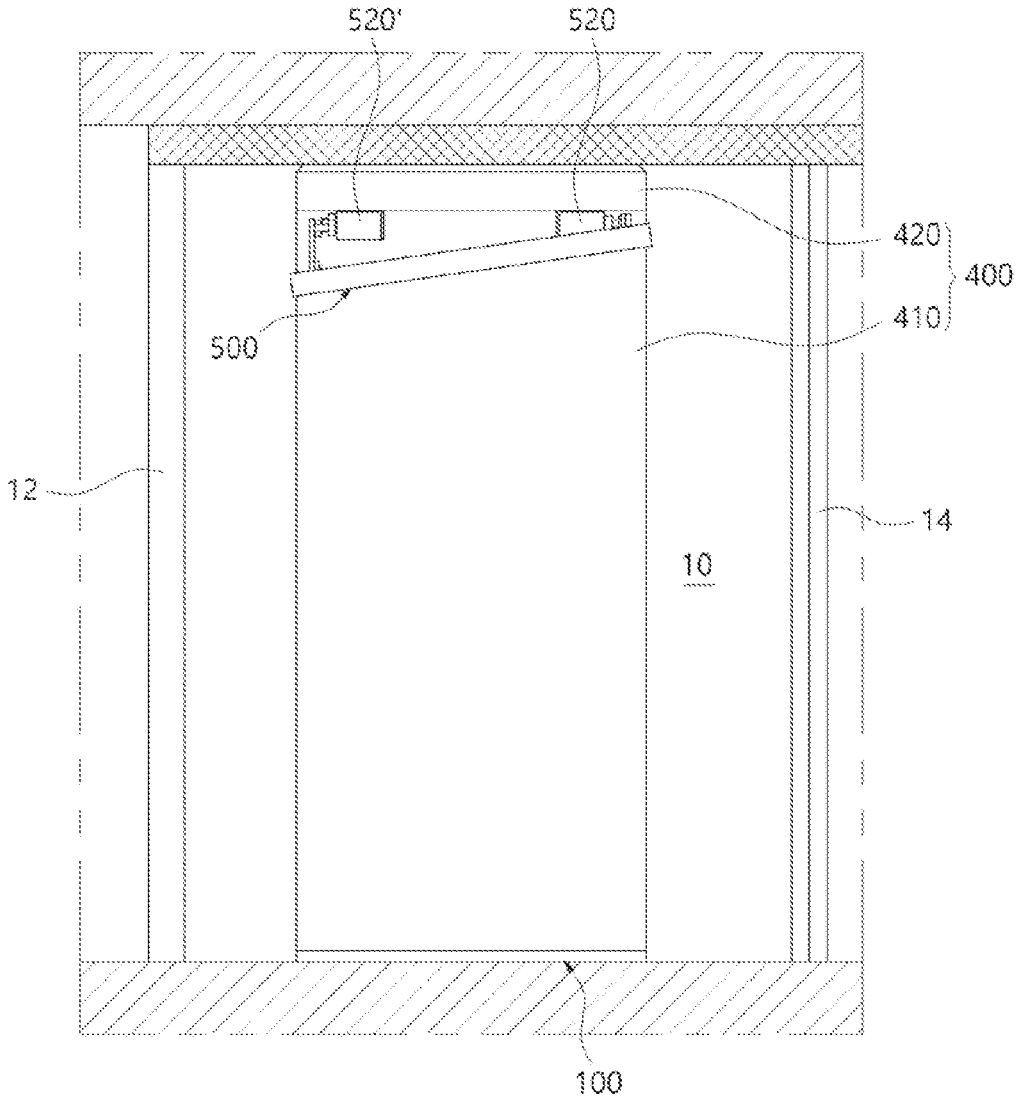

FIG. 19 is a view illustrating a state is which the air discharger is inclined toward an inside door according to an embodiment of the present invention.

Figure 20:
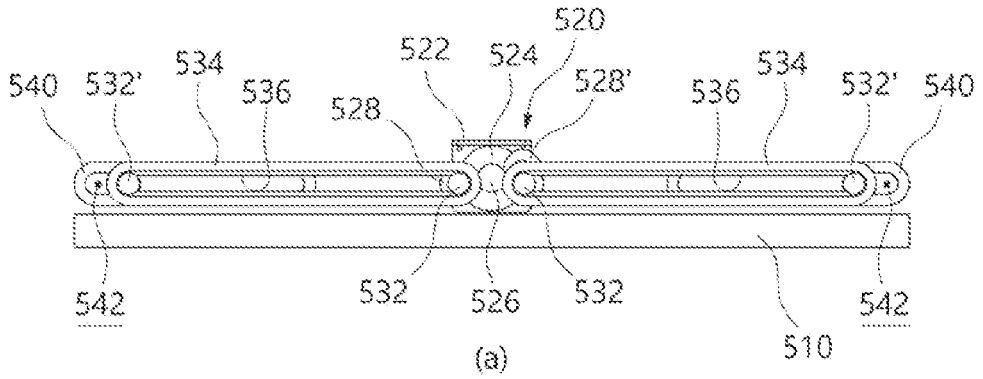
Figure 20:
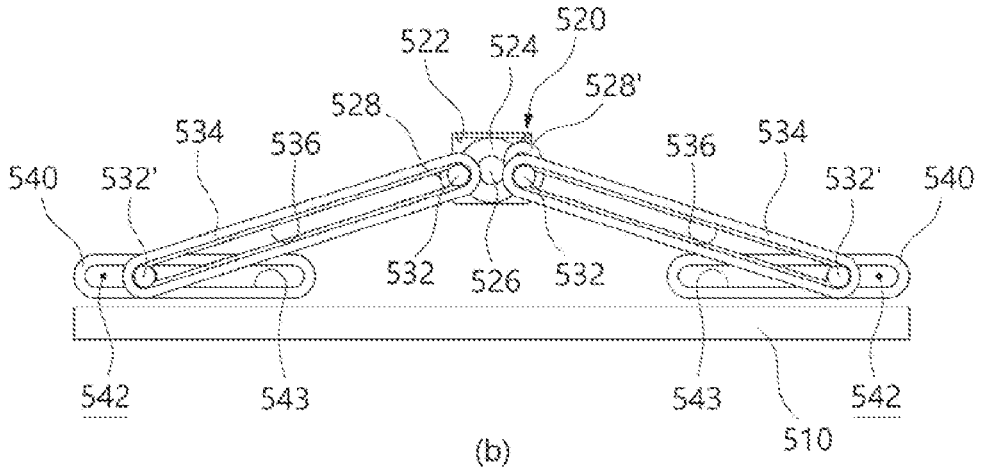

(a) of FIG. 20 and (b) of FIG. 20 are views illustrating a state in which the first lift operates according to an embodiment of the present invention.

Figure 21:
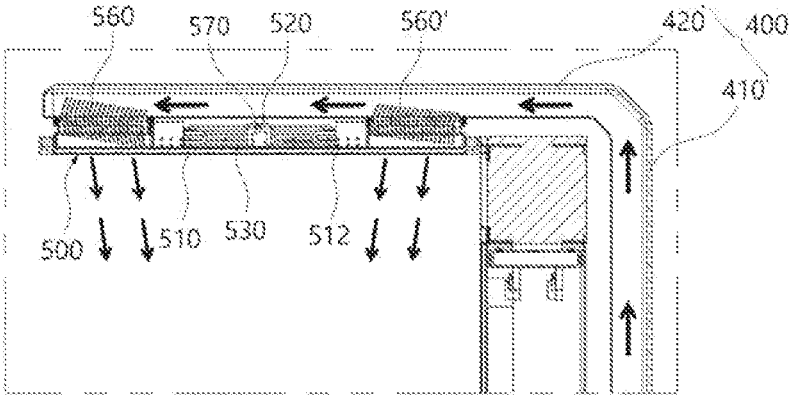

FIG. 21 is a view illustrating a state in which the air guide unit discharges air through a discharge hole in the embodiment of the present invention.

Figure 22:
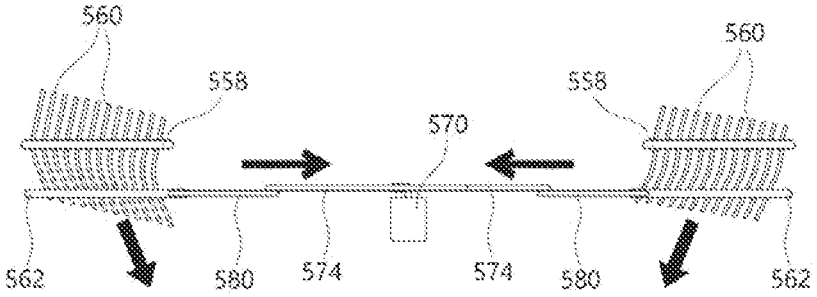
Figure 22:
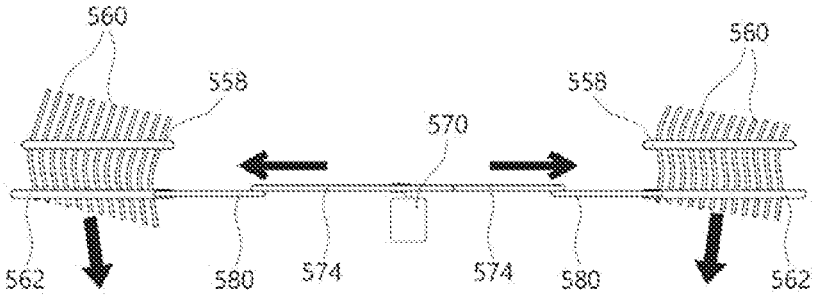

(a) of FIG. 22 is a view illustrating a state in which air can be discharged toward the center of the lower part of an entrance space, and (b) of FIG. 22 is a view illustrating a state in which air can be discharged toward the lower part of the entrance space.

DETAILED DESCRIPTION OF THE PREFERRED EMBODIMENTS

The present invention will now be described with reference to the accompanying drawings, wherein the same reference numerals have been used to identify the same or similar elements throughout the several views.

The exemplary embodiments of a hygiene management device for an entrance hall of the present disclosure will be described in detail with reference to the accompanying drawings.

The hygiene management device according to an embodiment of the present disclosure may be installed in an entrance space through which a person goes in and out of a specific indoor space. When the hygiene management device of the present disclosure is used for a residential space, the hygiene management device may be installed in a vestibule. When the hygiene management device of the present disclosure is used for an office space, the hygiene management device may be installed in space which is separately partitioned in the entrance hall of the associated office space. Space separately partitioned in such vestibule and entrance hall is referred to as an entrance space 10, and the entrance space 10 is seen in FIGS. 18 and 19. However, the hygiene management device according to an embodiment of the present disclosure may be installed in any type of space (i.e., a home, an office building, a store, etc.).

A footrest 100 may be installed on the bottom of the entrance space 10. The footrest 100 may have a predetermined area and may have an area for at least one person to stand on. As illustrated in the drawing, the footrest 100 has the shape of a rectangular plate. However, according to the shape of the bottom of the entrance space 10, the footrest 100 may have the shape of a plate or a plurality of plates (e.g., various plates). At least one person may stand on the footrest 100, however, any number of people may stand on the footrest 100.

Figure 5:
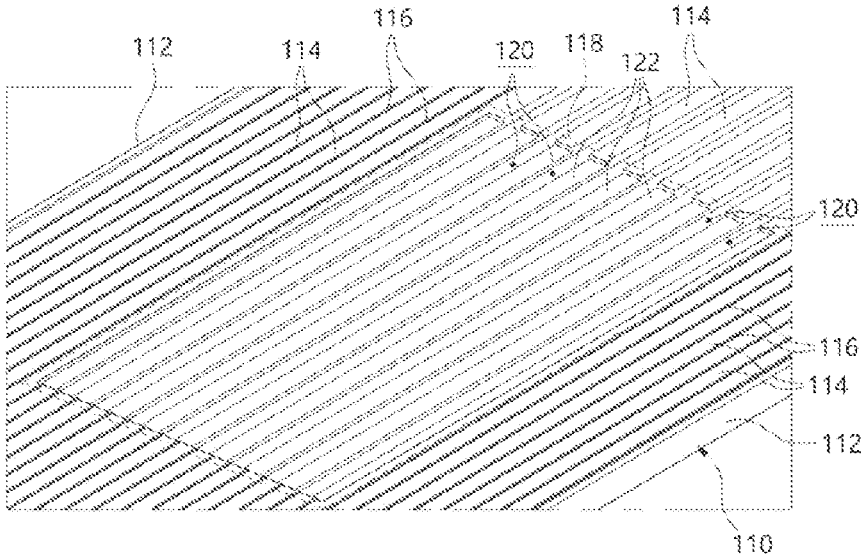
FIG. 5 is a partial perspective view illustrating the configuration of a base plate constituting the footrest of the hygiene management device according to an embodiment of the present invention.

The footrest 100 may function to support a person or multiple people. The footrest 100 enables the air from inside of the entrance space 10 to be introduced thereto by the operation of a fan assembly 300 to be described later. A base plate 110 may constitute the frame of the footrest 100. The base plate 110 may constitute the bottom of the footrest 100. As illustrated in FIG. 5, a sidewall 112 surrounding the edge of the base plate 110 may be formed by protruding to a predetermined height therefrom. That is, the sidewall 112 may extend vertically in a direction perpendicular to an extension direction of the base plate 110 and may surround an edge (or more than one edge) of the base plate 110. The entirety of the base plate 110 may be integrally formed. However, the base plate 110 may be formed by being divided into several pieces.

A seating surface 114 may be formed on the upper surface of the base plate 110. The seating surface 114 may be formed on most of the upper surface of the base plate 110. At least one guide rib 116 may be formed on the seating surface 114 by extending long in one direction (e.g., extending along a longitudinal direction of the base plate 110). The guide rib(s) 116 may extend across the entrance space 10 in a transverse direction that is transverse to an entrance direction (i.e., a direction in which a user enters the hygiene management device). The guide rib(s) 116 may extend to be parallel to the outside door 12 or inside door 14 (see FIG. 18) of the entrance space 10. The guide rib(s) 116 may function to guide the installation position of at least one support bar 130 to be described later. Multiple guide ribs 116 may be formed at predetermined intervals side by side on the seating surface 114. The support bar(s) 130 may be located between the guide ribs 116.

An introduction area 118 may be formed in a predetermined area of the upper surface of the base plate 110. The introduction area 118 is indicated by a dotted line in FIG. 5. The introduction area 118 may have a surface lower than the surface of the seating surface 114.

An introduction flow path 120 may be formed in the introduction area 118. The introduction flow path 120 may include multiple introduction flow paths formed side by side (i.e., adjacent one another). The introduction flow path 120 may extend past the introduction area 118 to an edge of the base plate 110. The introduction flow path 120 may have the lowest surface in the base plate 110. Air introduced through a gap between the support bars 130, as described below, may be transferred through the introduction flow path 120 to an air management module 200, which is described below.

In the introduction area 118, a seating area 122 may be formed between the introduction flow paths 120. The seating area 122 may have a surface higher than the surface of the introduction flow path 120 and lower than the surface of the seating surface 114. A substrate 124 may be located on the seating area 122. In the drawing, the seating area 122 has a surface having a predetermined height in the entirety of the introduction area 118. However, to securely support the support bar(s) 130, the seating area 122 may have protrusion parts formed at intervals thereon such that each of the protrusion parts has a surface having the same height as the height of the surface of the seating surface 114. The protrusion part may be formed in the entire width of the seating area 122. The protrusion parts may be formed in a portion of the width of the seating area 122.

A light source 126 may be mounted to the substrate 124. The light source 126 may generate ultraviolet (e.g., Far-UV or any type of ultraviolet light) for sterilization and disinfection, as known in the art. The light source 126 may include multiple light sources installed at predetermined intervals on the substrate 124. A light transmission member 128 may be used to transmit ultraviolet light emitted from the respective light source 126 (i.e., there may be a light transmission member for each light source 126). The light transmission member 128 is intended to transmit ultraviolet light to an upper side of the footrest 100. In the illustrated embodiment, the light transmission member 128 may extend long along the seating area 122 (e.g., between adjacent support bars 130), and may be shaped like a band having a height larger than a width. The light transmission member 128 may transmit ultraviolet light emitted by multiple light sources 126 mounted to the substrate 124 to the upper side of the footrest 100.

The multiple support bars 130 may be mounted to the base plate 110. The multiple support bars 130 may be sequentially installed side by side to be adjacent to each other on the base plate 110. The surface of a side of the support bars 130 (i.e., a top surface of the support bars 130) may constitute the upper surface of the footrest 100. The support bar 130 may sit on the seating surface 114 of the base plate 110. The support bar 130 may sit between the guide ribs 116 (i.e., each support bar 130 may be provided between adjacent guide ribs 116).

The support bar 130 may have a rectangular cross-section or may have any other shape. The support bar 130 may extend long in one direction (e.g., each support bar 130 may have an extension direction that is parallel to an extension direction of the introduction flow path 120). A through hole 132 may be formed through the inside of the support bar 130. That is, the support bar 130 may be formed long in the shape of a hollow rectangular column. Accordingly, when the support bar 130 has a hollow shape, the footrest 100 may secure durability against external forces and may reduce entire weight thereof. That is, the support bar 130 provides the footrest 100 with resistance to external impact and other forces (such as the force caused by a user or multiple users standing on the footrest 100).

The support bar 130 may be supported by being seated on the seating surface 114 of the base plate 110. A part of the support bar 130 passing through the introduction area 118 may be seated on the protrusion part of the seating area 122 or on the substrate 124 located on the seating area 122 to be supported thereby. Inclined surfaces 134 may be formed along the width-directional opposite ends, respectively, of the upper surface of each support bar 130. Due to the formation of the inclined surfaces 134, ultraviolet light transmitted through the light transmission member 128 may be spread and transmitted to the upper side of the footrest 100. Additionally, in the inclined surfaces 134, an inclined surface 134 at a side at which the light transmission member 128 is not provided allows air introduction into the introduction flow path 120 to be more efficiently performed.

The length of each of the support bars 130 may, for example, correspond to a length between the first end of the base plate 110 and the second end thereof. Each of the support bars 130 may be sequentially disposed in the extending direction of the guide rib 116 or the introduction flow path 120 to constitute the surface of the footrest 100.

An introduction slot 136 may be formed between the support bars 130 adjacent to each other (i.e., adjacent support bars) at a position corresponding to the introduction flow path 120. A gap between the support bars 130 adjacent to each other may be the introduction slot 136, so air in the entrance space 10 may be introduced to the introduction slot 136 by the fan assembly 300. The introduction slot 136 may have a width corresponding to a thickness of the guide rib 116. Foreign matter larger than the width of the introduction slot 136 may be prevented from being introduced into the introduction flow path 120. Accordingly, the support bars 130 may function as a kind of filter which prevents relatively large foreign matter from being introduced into the introduction flow path 120.

The air management module 200 may be provided to manage air flowing through the introduction flow path 120. The air management module 200 may remove foreign matter mixing with air introduced through the introduction flow path 120, and may manage the humidity and temperature of the air.

Figure 7:
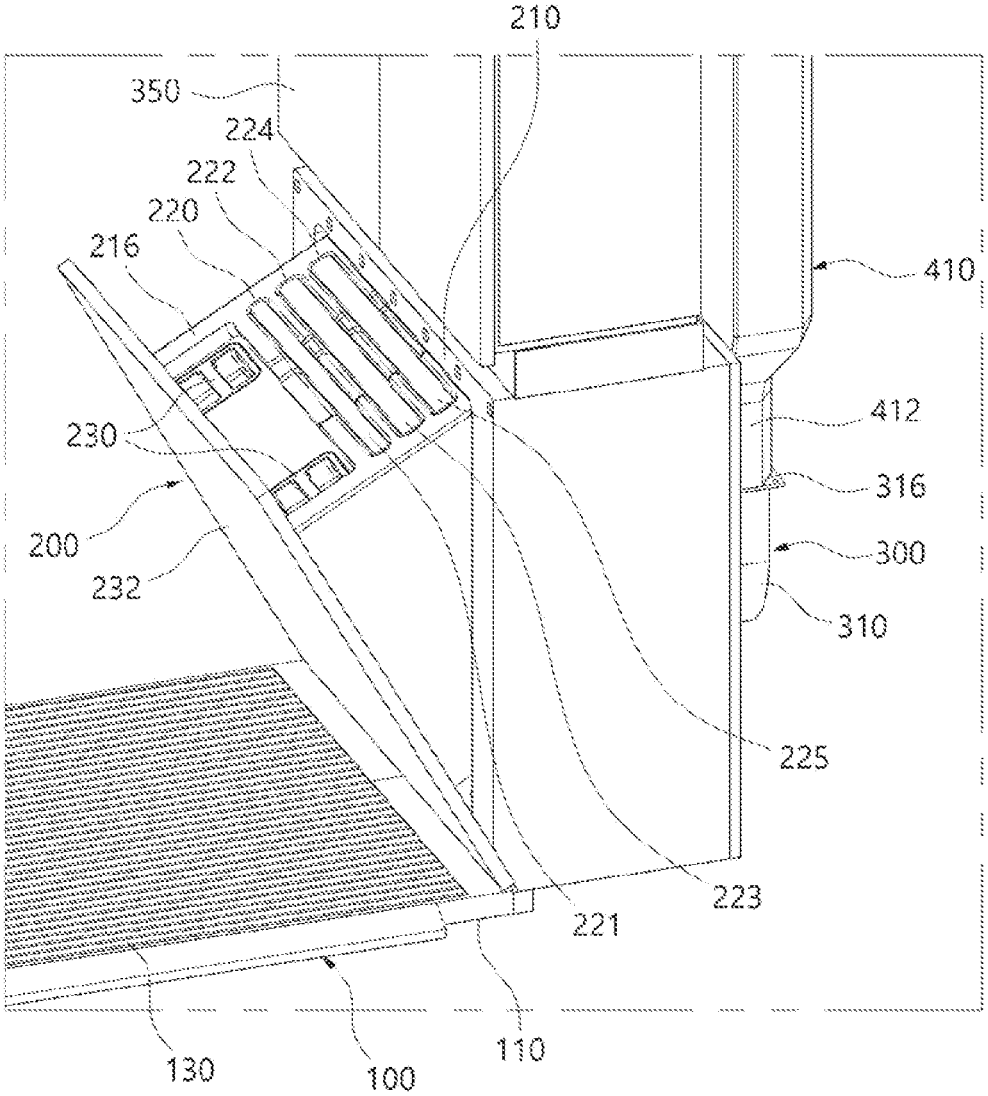
FIG. 7 is a perspective view illustrating the opened state of the air management module of the hygiene management device according to an embodiment of the present invention.
Figure 8:
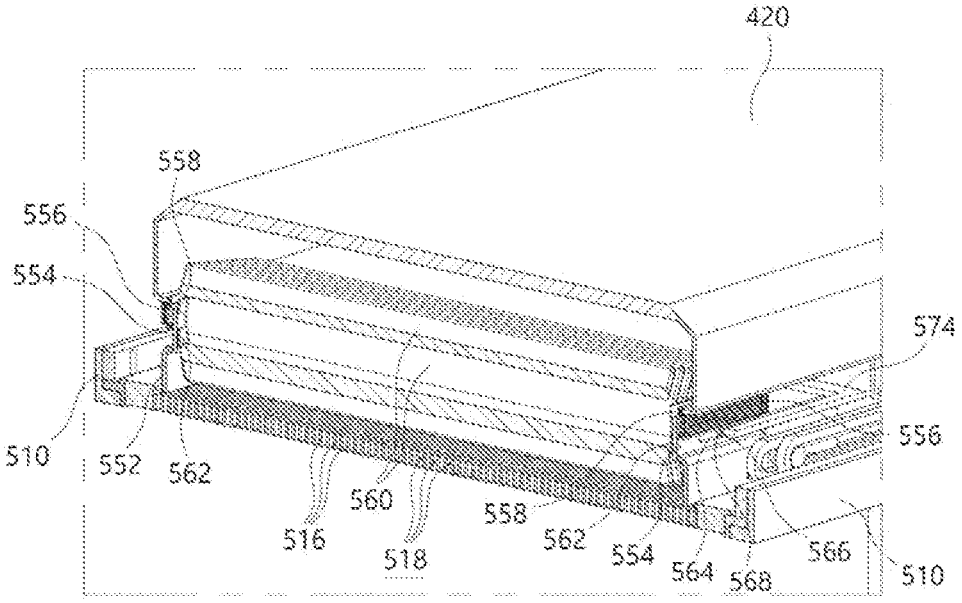
FIG. 8 is a sectional perspective view illustrating the configurations of an air discharger and the second outlet of a duct in the hygiene management device according to an embodiment of the present invention.

A fixed frame 210 may constitute the frame of the air management module 200. An internal space 212 may be defined in the fixed frame 210. The internal space 212 may be formed through the fixed frame 210 in a front-to-rear direction. An entry/exit frame 216 may be installed in the internal space 212 such that the entry/exit frame 216 rotates at a predetermined angle relative to the fixed frame 210 through an entry/exit hinge 214. The first side of the entry/exit hinge 214 may be fixed to each of the opposite inner surfaces of the internal space 212 of the fixed frame 210, and the second side of the entry/exit hinge 214 may be fixed to each of the opposite outer surfaces of the entry/exit frame 216. Accordingly, while the entry/exit frame 216 rotates at a predetermined angle relative to the entry/exit hinge 214, the entry/exit frame 216 may move in and out of the internal space 212. In FIG. 7, a state in which the entry/exit frame 216 protrudes to the outside of the internal space 212 is illustrated.

A communication path 218 may be formed through the entry/exit frame 216 in a front-to-rear direction thereof. The communication path 218 may be a path through which air introduced through the introduction flow path 120 passes. A first slot 220, a second slot 222, and a third slot 224 may be formed side by side in the entry/exit frame 216. As illustrated in FIG. 7, the first slot 220, the second slot 222, and the third slot 224 may be open to the upper surface of the entry/exit frame 216.

A first filter 221 may be located in the first slot 220, a second filter 223 may be located in the second slot 222, and a third filter 225 may be located in the third slot 224. The communication path 218 may pass through the entry/exit frame 216 in the front-to-rear direction, and the first slot 220, the second slot 222, and the third slot 224 may extend vertically to be open to the upper surface of the entry/exit frame 216 (i.e., the first slot 220, the second slot 222, and the third slot 224 may be open at an upper surface of the entry/exit frame 216). Accordingly, the first filter 221, the second filter 223, the third filter 225 located in the first slot 220, the second slot 222, and the third slot 224, respectively, may be located in the communication path 218. Each of the first filter 221, the second filter 223, and the third filter 225 may have a specific function. For example, the first filter 221 may have the function of removing moisture. The second filter 223 may have the function of removing dust and fine dust. The third filter 225 may have an antibacterial function.

For example, a water collector 228 collecting moisture removed from air flowing through the first filter 221 may be provided at a side of the lower part of the entry/exit frame 216. The inlet of the water collector 228 may be located at the lower portion of the first slot 220. A connection pipe 229 may be located in the entry/exit frame 216 so as to transfer water collected in the water collector 228 to the upper side.

A drain container 230 may be located at the upper portion of the entry/exit frame 216. The drain container 230 collects water transferred through the connection pipe 229. When the entry/exit frame 216 protrudes to the front side of the fixed frame 210, the drain container 230 may be exposed to a user. Accordingly, the user may separate the drain container 230 from the entry/exit frame 216 to remove water. That is, the drain container 230 may be removably attached to the entry/exit frame 216. The transfer of water from the water collector 228 to the drain container 230 may be performed by a pump or capillary action.

A front cover 232 may be installed on the entry/exit frame 216. The front cover 232 may constitute the exterior of the front surface of the air management module 200. The front cover 232 may move together with the entry/exit frame 216 while shielding the entry/exit frame 216.

A component which transfers air flowing through the introduction flow path 120 to the communication path 218 may be provided in the air management module 200. A fixed connection duct 234 may be connected to the introduction flow path 120 and may be located at the lower portion of the fixed frame 210. The introduction flow path 120 may be connected to the inlet of the fixed connection duct 234. The fixed connection duct 234 may be located on the rear surface of the front cover 232 by extending long in a side-to-side direction. The side-to-side width of the fixed connection duct 234 may be the same as the length of the corresponding edge of the introduction area 118 formed in the footrest 100.

A rotating connection duct 236 may be provided at the outlet of the fixed connection duct 234. The rotating connection duct 236, which is mounted to the fixed connection duct 234, may rotate by a predetermined angle. The rotating connection duct 236 may be made separately from the fixed connection duct 234 and may be assembled with the fixed connection duct 234 to be rotatable by a predetermined angle.

A movable duct 238 may be provided on the rear surface of the front cover 232 or the entry/exit frame 216 (i.e., or a surface of the entry/exit frame 216). The movable duct 238 may operate together with the front cover 232 or the entry/exit frame 216. The rotating connection duct 236 may be located in the inlet of the movable duct 238 formed in a lower portion of the movable duct 238. The outlet of the movable duct 238 may be open toward the communication path 218 of the entry/exit frame 216. Accordingly, air flowing to the fixed connection duct 234 may flow through the rotating connection duct 236 to the movable duct 238, and may flow from the movable duct 238 to the communication path 216. The exit of the movable duct 238 may always be directed to the communication path 218, and the movable duct 238 may move together with the entry/exit frame 216 in which the communication path 218 is formed, so air flowing from the movable duct 238 may stably flow to the communication path 218.

A heat exchanger 240 may be provided on the rear end of the fixed frame 210. The heat exchanger 240 may be installed to face the third filter 225. The heat exchanger 240 may be installed inside a heat exchanger casing 242. Air may flow through the heat exchanger casing 242 in a front-to-rear direction. The outlet of the heat exchanger casing 242 may communicate with a housing inlet 312 of the fan assembly 300, which is described below. The heat exchanger 240 may exchange heat with air flowing through the communication path 218. For the operation of the heat exchanger, there may be provided components for heat exchange cycle, as known in the art. Reference numeral 244 denotes a compressor.

The heat exchanger 240 is intended to set the temperature of air flowing through the air management module 200. Accordingly, a heater may be used instead of the heat exchanger 240.

Figure 6:
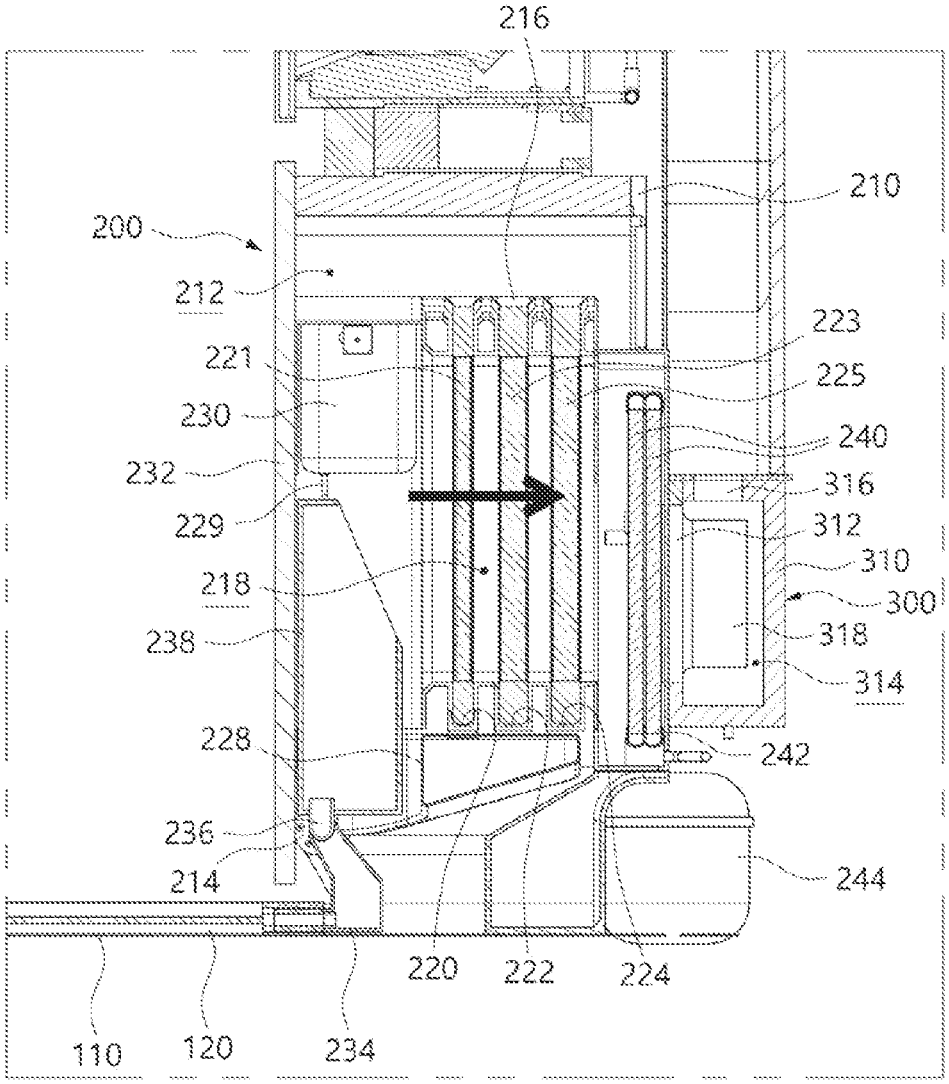
FIG. 6 is a sectional view illustrating the internal configuration of an air management module of the hygiene management device according to an embodiment of the present invention.

The fan assembly 300 may be mounted to the rear surface of the air management module 200, that is, to the outlet of the air management module 200 through which air flows out. The fan assembly 300 may supply a driving force which allows air to flow in the hygiene management device of the present disclosure. In FIG. 6, the configuration of the fan assembly 300 is illustrated as a sectional view, and the section of the fan assembly 300 is located at a position different from the positions of the sections of other parts of FIG. 6, but is illustrated at the associated position for convenience. A fan housing 310 may constitute the exterior of the fan assembly 300. The housing inlet 312 may be formed in the first side of the fan housing 310. The housing inlet 312 may be open to the air management module 200. A predetermined housing internal space 314 may be defined inside the fan housing 310. A housing outlet 316 may be formed in the second side of the fan housing 310. The second side of the fan housing 310 may be adjacent to the first side of the fan housing 310. The housing inlet 312 may communicate with the outlet of the heat exchanger casing 242, and the housing outlet 316 may communicate with the duct 400, as described below.

A fan 316 may be installed in the fan housing 310. The fan 318 may be driven by a driving source, may introduce air to the fan housing 310 through the housing inlet 312 located in the front surface of the fan housing 310, and may discharge the air through the housing outlet 316 located at the outer surface of a side of the fan housing 310. When the fan 318 is a centrifugal fan, the housing outlet 316 may be configured to be open in the centrifugal direction of the fan 318.

A function module 350 may be installed at a position corresponding to the upper portion of the air management module 200. There may be a clothing management device as an example of the function module 350. When clothes are placed inside the clothing management device, the clothing management device can remove dust from the clothes or sterilize the clothes. The clothing management device may also function to unwrinkle clothing (i.e., remove wrinkles from clothing, such as by steaming). As other examples of the function module 350, there may be various devices such as a shoe management device, an umbrella management device, a belongings management device, a shoe storage device, an umbrella storage device, and a belongings storage device. For reference, each of these function modules 350 may not be configured as an independent function module, but some of the function modules may be combined with each other. The function module 350 may communicate with an indoor area. That is, the inside of the function module 350 may be configured to be open to the indoor area.

The duct 400 may function to move the flow of air generated in the fan assembly 300 to the upper portion of the entrance space. The duct 400 may include a first duct 410 and a second duct 420. The first duct 410 may extend along the side wall of the entrance space. The first inlet 412 of the first duct 410 may be connected to the housing outlet 316 of the fan assembly 300. The first inlet 412 may have a relatively small flow cross-sectional area compared to other portions of the first duct 410. The first duct 410 may have a branch flow path for supplying air to the function module 350. There may be a separate damper inside each of the branch flow path and rest of the first duct 410 (i.e., a portion of the first duct 410 other than the branch flow path) to control the flow of air.

The second duct 420 may be located on the ceiling of the entrance space 10. The second duct 420 may be a part in which air flowing through the first duct 410 flows. The second duct 420 may supply air to an air discharger 500, which is described below. To this end, a first outlet 422 and a second outlet 424 may be provided in the second duct 420. The first outlet 422 may be located at the relatively upstream portion of the second duct 420, and the second outlet 424 may be located at the relatively downstream portion of the second duct 420 compared to the first outlet 422. The first outlet 422 may be located to be closer to the first duct 410 than the second outlet 424.

Referring to FIGS. 8 to 11, the air discharger 500 may be mounted to the second duct 420 or the ceiling of the entrance space 10. The air discharger 500 may discharge air transferred through the duct 400 to a user located in the entrance space 10. The air discharger 500 may discharge air transferred through the first outlet 422 and the second outlet 424 in various directions. Particularly, the air discharger 500 may move within a predetermined angle range such that the air discharger 500 is directed in a direction in which a person goes in or out of the entrance space 10.

Figure 10:
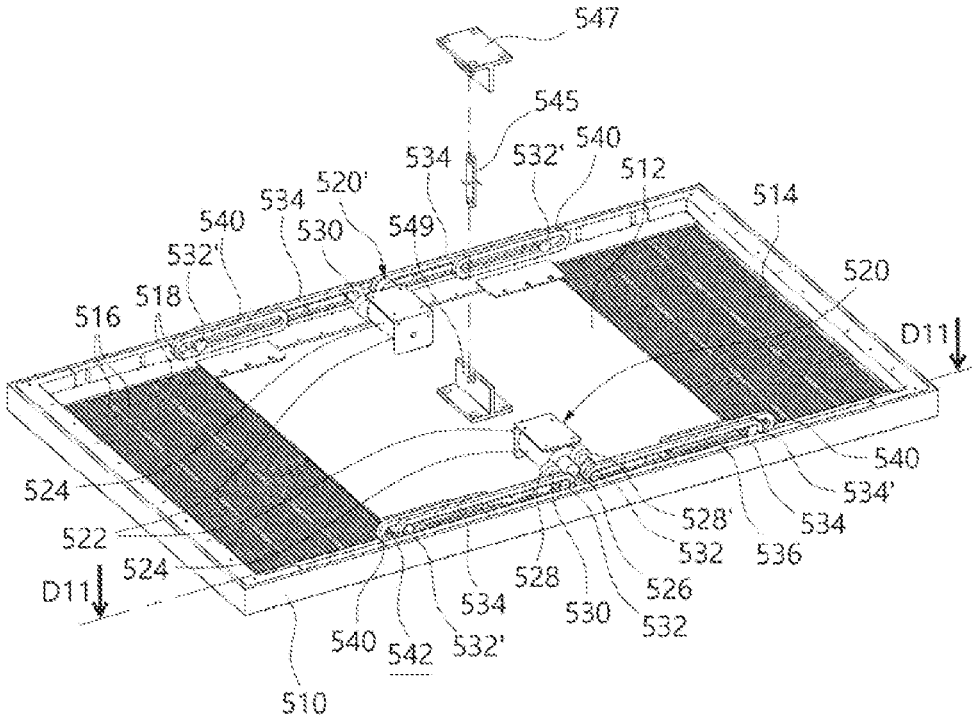
FIG. 10 is a perspective view illustrating a state in which the first and second lifts are provided in the air discharger of the hygiene management device according to an embodiment of the present invention.

A discharger frame 510 may constitute the frame of the air discharger 500. As illustrated in FIG. 10, a mounting plate 512 may constitute at least a portion of the upper surface of the discharger frame 510. A through part 514 may be formed in a portion of the mounting plate 512. The through part 514 may be formed at each of the opposite sides of the mounting plate 512. In the embodiment of the present disclosure, the through parts 514 may be formed at positions, respectively, corresponding to the first outlet 422 and second outlet 424 of the second duct 420. The through part 514 may be open to the lower surface of the air discharger 500 by passing through the discharger frame 510.

Multiple louvers 516 may be installed at predetermined intervals on the bottom surface of the discharger frame 510. The louvers 516 may be installed on the entire bottom surface of the discharger frame 510. Of course, the louvers 516 may be installed only at positions corresponding to the through parts 514. Air may be discharged through a gap between the louvers 516. The through part 514 in which the louvers 516 are installed may be a discharge hole 518. Accordingly, two discharge holes 518 may be formed in the bottom surface of the air discharger 500. However, any number of discharge holes 518 may be formed in the bottom surface of the air discharger 500.

Although the louver 516 is illustrated to be fixed without moving in the drawing, the louver 516 may rotate at predetermined angle relative to opposite ends of the louver 516 to adjust the direction of air to be discharged through the discharge hole 518.

As illustrated in FIG. 10, the first and second lifts 520 and 520' may be provided in the air discharger 500. The first and second lifts 520 and 520' may adjust the operation angle of the air discharger 500. The first lift 520 and the second lift 520' may be installed on the opposing edges of the air discharger 500, respectively, and may adjust a direction in which the lower surface of the air discharger 500 is directed. The first and second lifts 520 and 520' may be installed near the opposite edges, respectively, of the upper surface of the air discharger 500. In other words, the first rift 520 may be installed at a position of the air discharger 500 adjacent to the inside door 14, and the second lift 520' may be installed at a position of the air discharger 500 adjacent to the outside door 12.

A portion of each of parts of the first and second lifts 520 and 520' may be mounted to the duct 400 or the ceiling of the entrance space 10, and the remaining portion thereof may be mounted to the discharger frame 510. Due to a specific part of the discharger frame 510 moved up and down by the lifts 520 and 520', a direction to which the lower surface of the air discharger 500 is directed may be adjusted.

The configuration of each of the first and second lifts 520 and 520' may be the same, and only the installation location thereof may be different. Accordingly, the configuration of each of the lifts will be described based on the first lift 520. A mounting bracket 522 may be mounted to the duct 400 or the ceiling of the entrance space 10. Of course, in a state in which the mounting bracket 522 of the first lift 520 and the mounting bracket 522 of the second lift 520' are mounted to one plate, the plate may be mounted to the duct 400 or the ceiling of the entrance space 10.

Referring to FIG. 10, (a) of FIG. 20 and (b) of FIG. 20, a drive motor 524 may be mounted to the mounting bracket 522. The drive motor 524 may provide a driving force for the operation of the lifts 520 and 520'. A driving gear 526 may be mounted to the output shaft of the drive motor 524. A following gear 528 may be installed to be engaged with the driving gear 526. The following gear 526 may be rotatably mounted to the mounting plate 512. The following gear 528 may include a pair of following gears 528. Due to the use of the pair of following gears 528, each of components related to the following gear 528 may also be provided as a pair. Hereinafter, only a side of each of these pairs of components will be described. However, an additional gear train 528' may be connected to a following gear 528 at a side for the direction of the air discharger 500 moved up/down by the operation of a drive member 536 to be described below.

There may be provided an interlocking shaft 530 that rotates by receiving the rotational force of the following gear 526, and the interlocking shaft include a first interlocking gear 532. The first interlocking gear 532 may be mounted rotatably to a casing 534. The first interlocking gear 532 may drive the drive member 536 installed in the casing 534.

The casing 534 may be formed in an elliptical shape, or may have any other shape. A cross-section of one side of the casing 534 may have a "U" shape, and the drive member 536 having a caterpillar shape may be installed in the casing. An example of the drive member 536 may be a timing belt or chain. When a chain is used as the drive member 536, sprockets may be used for the first interlocking gear 532 and a second interlocking gear 532'. The casing 534 may be configured such that the long axis of the elliptical shape thereof is relatively longer than the short axis. The length of the casing 534 may be appropriately preset in consideration of the rotation angle of the air discharger 500.

A through slot 534' may be formed in the casing 534 to be long in the longitudinal direction thereof. The through slot 534' may extend long on the casing 534 having an elliptical shape in the longitudinal direction thereof. In the casing 534, the second interlocking gear 532' may be installed on an end portion opposite to a side at which the first interlocking gear 532 is installed. The second interlocking gear 532' may be mounted rotatably to the casing 534.

Figure 11:
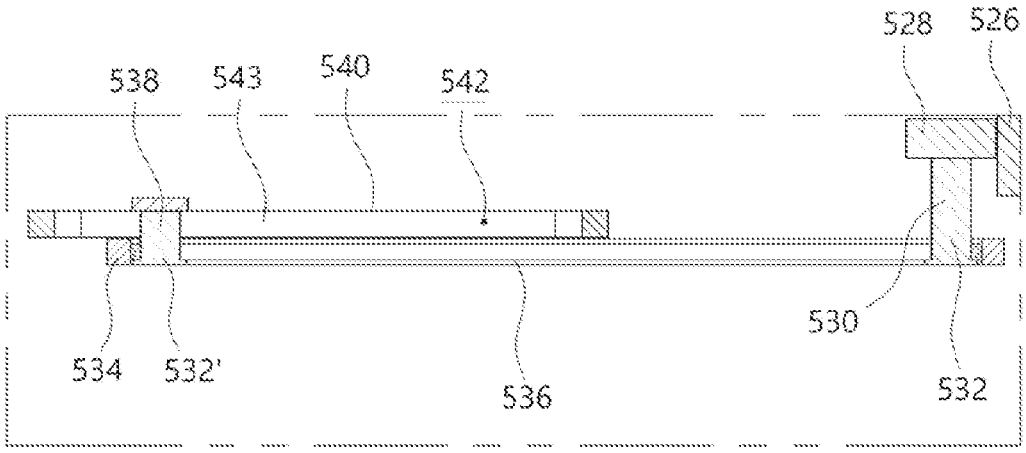
FIG. 11 is a sectional view taken along line D11-D11 of FIG. 10.

As illustrated in FIG. 11, a pinion gear 538 coaxial with the second interlocking gear 532' is provided. The pinion gear 538 may rotate together with the rotation of the second interlocking gear 532'. The pinion gear 538 may move along a rack slot 542 to be described below. The pinion gear 538 may operate by engaging with a rack gear 543 provided in the rack slot 542.

In order to move a specific position of the discharger frame 510 up and down by the operation of the second interlocking gear 532' and the pinion gear 538, a rack guide 540 may be installed at a side of the discharger frame 510. The rack slot 542 by which the pinion gear 538 is guided may be formed in the rack guide 540 such that the rack slot is long in one direction. The rack guide 540 may be installed to extend along the edge of the mounting plate 512. The rack gear 543 may be formed in the rack slot 542 of the rack guide 540. The rack gear 543 may operate in engagement with the pinion gear 538 such that the pinion gear 538 can move relatively in the rack slot 542. When the pinion gear 538 moves along the rack slot 542, the position of the pinion gear 538 may be changed in the rack slot 542, and thus the angle of the casing 534 in which the second interlocking gear 532' concentric to the pinion gear 538 is installed may be changed.

Meanwhile, in order to efficiently perform the angle adjustment of the air discharger 500, not only the first and second lifts 520 and 520' but also a separate component may be provided to support the weight of the air discharger 500. A universal joint 545 connected to the mounting plate 512 at a first end part thereof and connected to the duct 400 or the ceiling of the entrance space 10 at a second end part thereof may be used.

Alternatively, as illustrated in FIG. 10, a connection link 545, which is relatively rotatable at opposite ends thereof, may be used to be connected to the mounting plate 512 and the duct 400 or the ceiling of the entrance space 10 (i.e., to connect the mounting plate 512 to the duct 400 or ceiling of the entrance space 10). A first mounting piece 547 and a second mounting piece 549 may be rotatably connected to respective opposite ends of the connection link 545. The first mounting piece 547 may be fixed to the duct 400 or the ceiling of the entrance space 10, and the second mounting piece 549 may be fixed to the mounting plate 512. It is preferable that the universal joint 545 or the connection link 545 is located at the geometric center of the air discharger 500.

Figure 12:
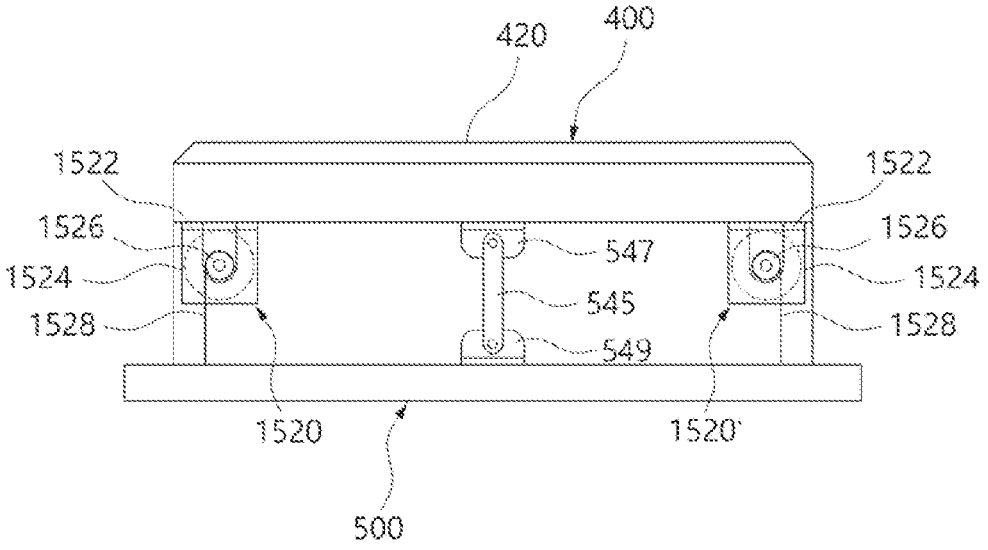
FIG. 12 is a side view illustrating the configuration of the lift of the hygiene management device according to another embodiment of the present invention.
Figure 13:
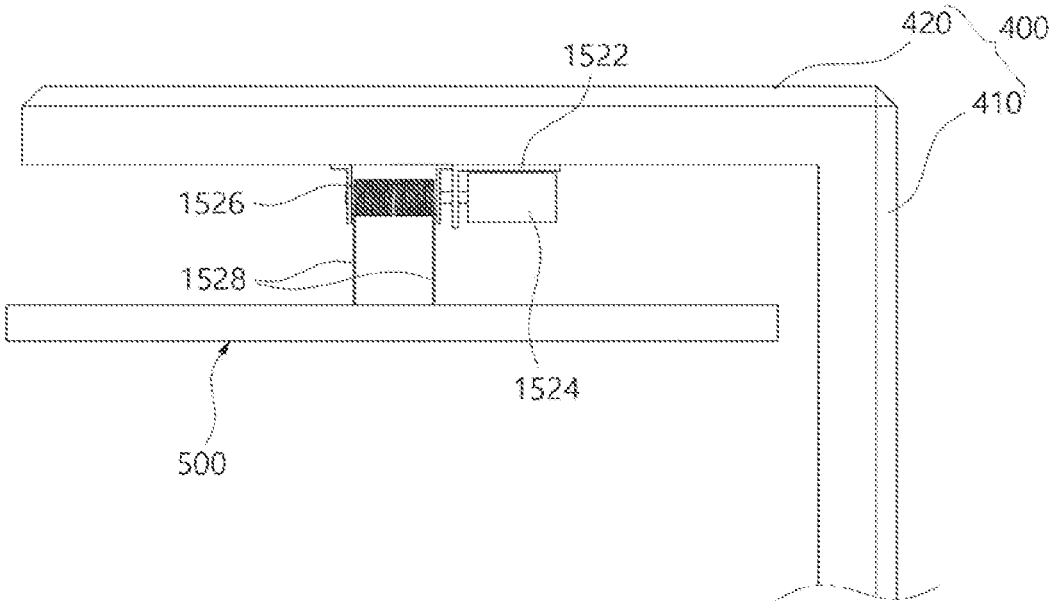
FIG. 13 is a view illustrating the lift illustrated in FIG. 12 from a different direction according to another embodiment of the present invention.

The first and second lifts 520 and 520' described above may be replaced by other components which perform the same functions. For example, as illustrated in FIGS. 12 and 13, each of first and second lifts 1520 and 1520' according to another embodiment may use a wire 1528 to adjust the angle of the air discharger 500. To put this simply, a drive motor 1524 may be mounted to the lower surface of the duct 400 or the ceiling of the entrance space 10 through a mounting bracket 1522.

A bobbin 1526 (i.e., spindle or cylinder) may be installed on the lower surface of the duct 400 or the ceiling of the entrance space 10 such that the bobbin 1526 is rotated by the output shaft of the drive motor 1524. The wire 1528 may be wound on the bobbin 1526. The wire 1528 may be wound on the bobbin 1526 while being fixed to the bobbin 1526 at a first end part of the wire 1528, and the second end part of the wire 1526 may be connected to the discharger frame 510 of the air discharger 500. At least two wires 1528 may be separately wound on one bobbin 1526 at first end parts of the two wires 1528, and the second end part of each of the two wires may be connected to the discharger frame 510 of the air discharger 500.

Accordingly, the first lift 1520 and the second lift 1520', using the wires 1528, may adjust the operation angle of the air discharger 500 by winding the wires 1528 on the bobbin 1526 or unwinding the wires 1528 from the bobbin 1526.

Figure 14:
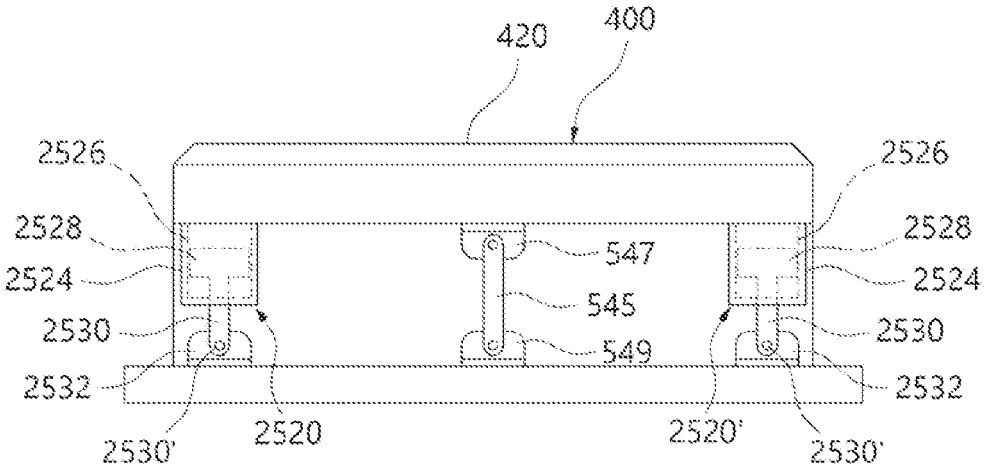
FIG. 14 is a side view approximately illustrating the configuration of a lift according to another embodiment of the present invention.
Figure 15:
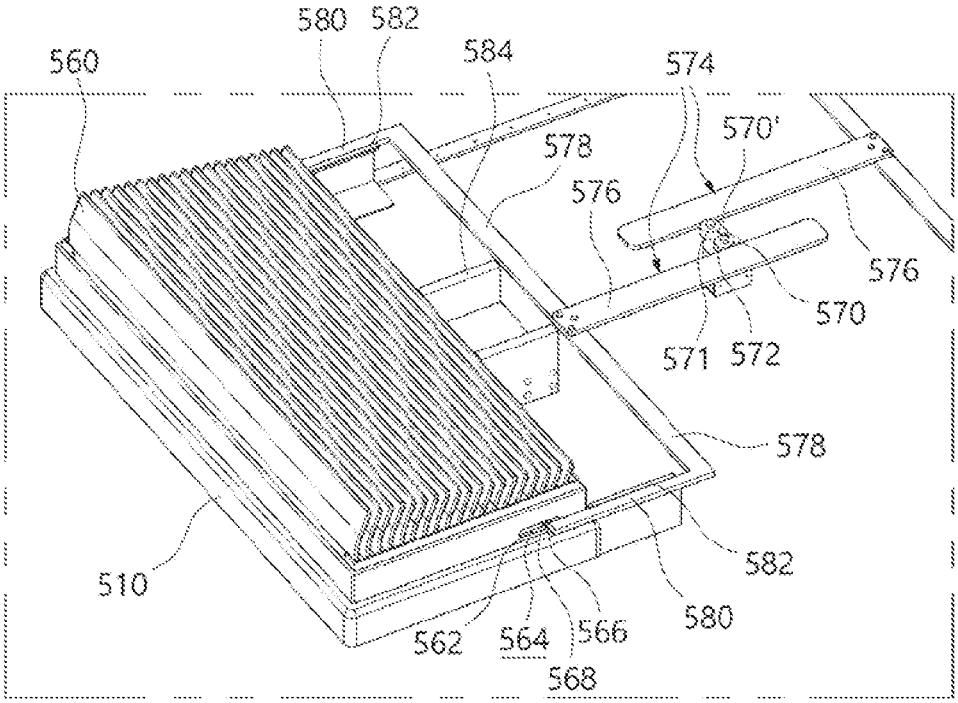
FIG. 15 is a perspective view illustrating the configuration of an air guide unit used in the hygiene management device according to the present invention.

In addition, in FIG. 14, the first and second lifts 2520 and 2520' having another configuration are illustrated. Here, an actuator 2524 may be used to adjust the operation angle of the air discharger 500. The actuator 2524 may be mounted to the duct 400 or the ceiling of the entrance space 10. As for the configuration of the actuator 2524, the actuator 2524 may include a piston 2528 which moves inside a cylinder 2526, and a lift rod 2530, which protrudes to a different degree to the outside of the cylinder 2526 according to the movement of the piston 2528. The piston 2528 may be moved inside the cylinder 2526 by pneumatic or hydraulic pressure. The front end of the lift rod 2530 may be connected to a connection piece 2532 via a connection pin 2530', and the connection piece 2532 may be mounted to the discharger frame 510 of the air discharger 500 such that the front end of the lift rod 2530 can rotate relative to the connection piece 2532. In the configuration of the actuator 2524 in FIG. 14, the protruding degree of the lift rod 2530 of the actuator 2524 toward the outside of the cylinder 2526 may be changed to adjust the operation angle of the air discharger 500.

Next, the configuration of each of air guide units 550 through which air is transferred from the first outlet 422 and the second outlet 424 of the duct 400 to the discharge holes 518 of the opposite sides of the air discharger 500 will be described. The air guide units 550 may be installed respectively between the first outlet 422 of the duct 400 and a first side discharge hole 518 of the discharger frame 510 and between the second outlet 424 of the duct 400 and a second side discharge hole 518 of the discharger frame 510. For convenience of explanation, the air guide unit 550 located at a position corresponding to the second outlet 424 will be described for reference.

A vane frame 552 may constitute the frame of each air guide unit 550. The shape of the vane frame 552 may correspond to the shape of the edge of the discharge hole (s) 518 and the shape of the edge of the second outlet 424. A flow path may be formed inside the vane frame 552 and may be a flow path connecting the second outlet 424 with the discharge hole (s) 518.

A connection neck 554 may be formed on the vane frame 552 by protruding therefrom toward the second outlet 424. The connection neck 554 may be configured to have a flow cross-sectional area smaller than the flow cross-sectional area of the vane frame 552. Multiple connection necks 554 may be provided for each air guide unit 550, and the connection necks 554 may be provided at opposing ends of the second duct 420. A corrugated pipe 556 may be installed between the connection neck 554 and the second outlet 424 to prevent the leakage of air. The corrugated pipe 556 may be flexible, and thus although the vane frame 552, together with the discharger frame 510, is moved relative to the duct 400 by the operation of the discharger frame 510, a connection state between the connection neck 554 and the second outlet 424 may be maintained. Accordingly, the leakage of air between the second outlet 424 and the vane frame 552 may be prevented.

A vane rotation center member 558 may be installed on each of the opposite inner surfaces of the vane frame 552. Multiple vanes 560 and 560' may be mounted to the vane rotation center member 558 to be rotatable at predetermined angles. The opposite ends of each of the vanes 560 and 560' may be mounted rotatably to the opposite sides of the vane rotation center member 556, respectively. The vane rotation center member 556 may not be separately provided, but the corresponding part of the vane frame 552 may perform, the same function as the vane rotation center member 556.

Figure 9:
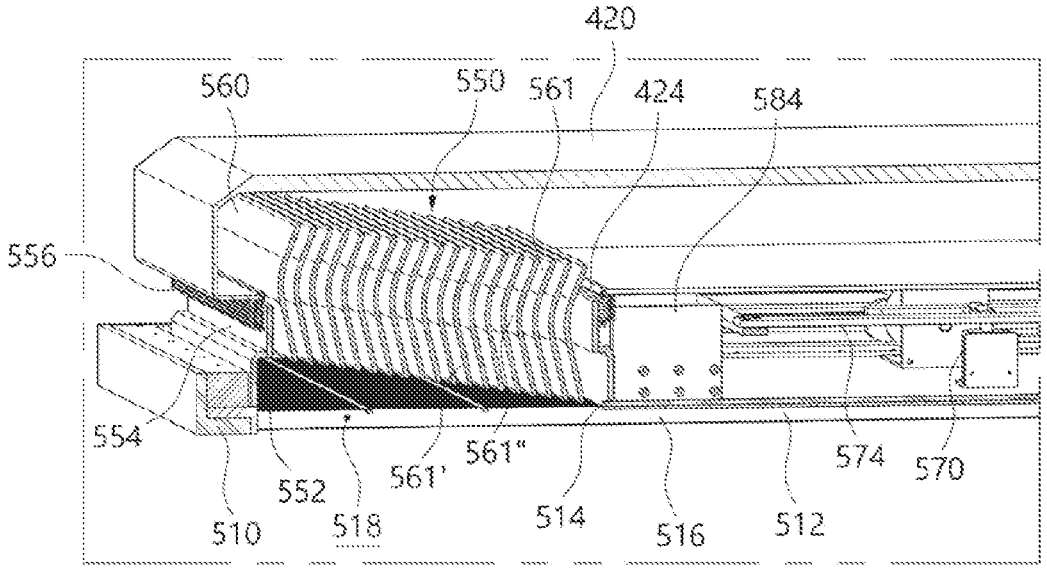
FIG. 9 is a longitudinal sectional perspective view of the duct illustrating the configurations or the air discharger and the second outlet of the duct in the hygiene management device according to an embodiment of the present invention.

Each of the vanes 560 and 560' may function to set the direction of air to be discharged through the discharge hole 518. As illustrated in FIG. 9, in the vane 560 or 560', an upper flow part 561 and a lower flow part 561' which are plates, respectively, having predetermined shapes may be connected to each other so as to have a predetermined angle therebetween. The upper flow part 561 and the lower flow part 561' may be connected to each other by a connection curved part 561" having a predetermined radius of curvature.

As for the shapes of the vanes 560 and 560', the vane 560' of the air guide unit 550 used at a position corresponding to the first outlet 422 may be formed to be slightly different from the vane 560 of the air guide unit 550 used at a position corresponding to the second outlet 424. In (a) of FIG. 16, the vanes 560 provided at a position corresponding to the second outlet. 424 are illustrated, and in (b) of FIG. 16, the vanes 560' provided at a position corresponding to the first outlet 422 are illustrated.

First, referring to the configuration of the vane 560 in (a) of FIG. 16, virtual extension surfaces extending from the upper flow part 561 and the lower flow part 561', respectively, may meet to form an obtuse angle therebetween. Each of the upper flow parts may at least partially extend towards an inside of the duct 400 (i.e., the second duct 420). The vane 560 having such a configuration may include multiple vanes disposed at predetermined intervals in the vane frame 552 (i.e., the vanes 560 may be spaced apart from one another at predetermined intervals and may have a predetermined curvature). Here, the start part of the upper flow part 561 of the vane 560 may be inclined toward the upstream portion of the second duct 420. The lower flow part 561' of the vane 560 may be inclined toward the center part of the footrest 100 gradually toward the end part of the lower flow part 561'.

Next, referring to the configuration of the vane 560' (b) of FIG. 16, virtual extension surfaces extending from the upper flow part 561 and the lower flow part 561', respectively, may be almost parallel to each other (or they may be parallel to each other). Here, the start part of the upper flow part 561 of the vane 560' may be inclined toward the upstream portion of the second duct 420. For reference, the inclining direction of the upper flow part 561 of the vane 560 and the upper flow part 561 of the vane 560 may be almost the same (i.e., substantially the same). However, the protruding degree of the upper flow part 561 of the vane 560' toward the inside of the second duct 420 may be shorter than the protruding degree of the upper flow part 561 of the vane 560 toward the inside of the second duct 420. The lower flow part 561' may be inclined toward the center part of the footrest 100 gradually toward an end part thereof.

Figure 1:
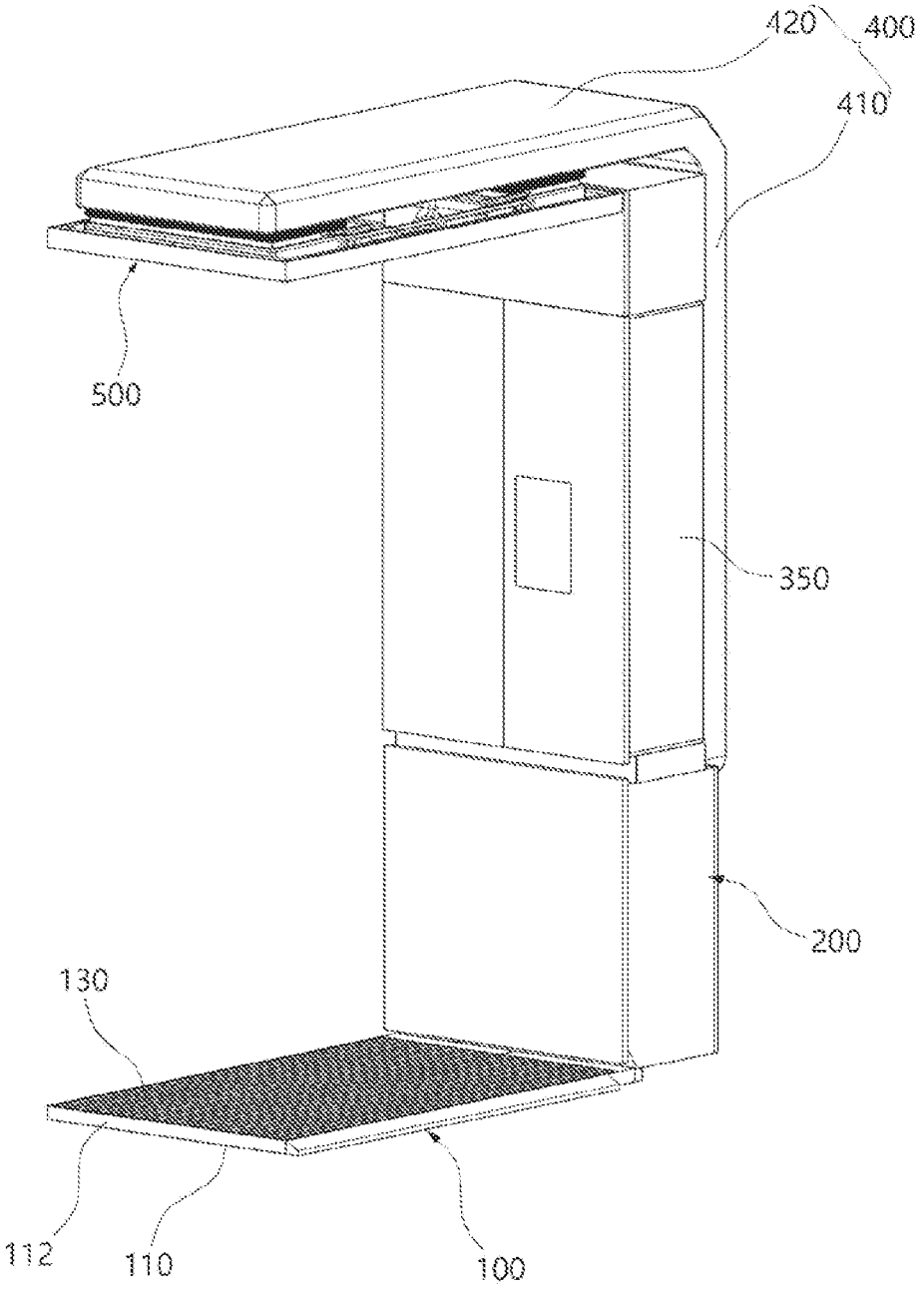
FIG. 1 is a perspective view illustrating the configuration of a hygiene management device for an entrance hall according to an embodiment of the present invention.
Figure 2:
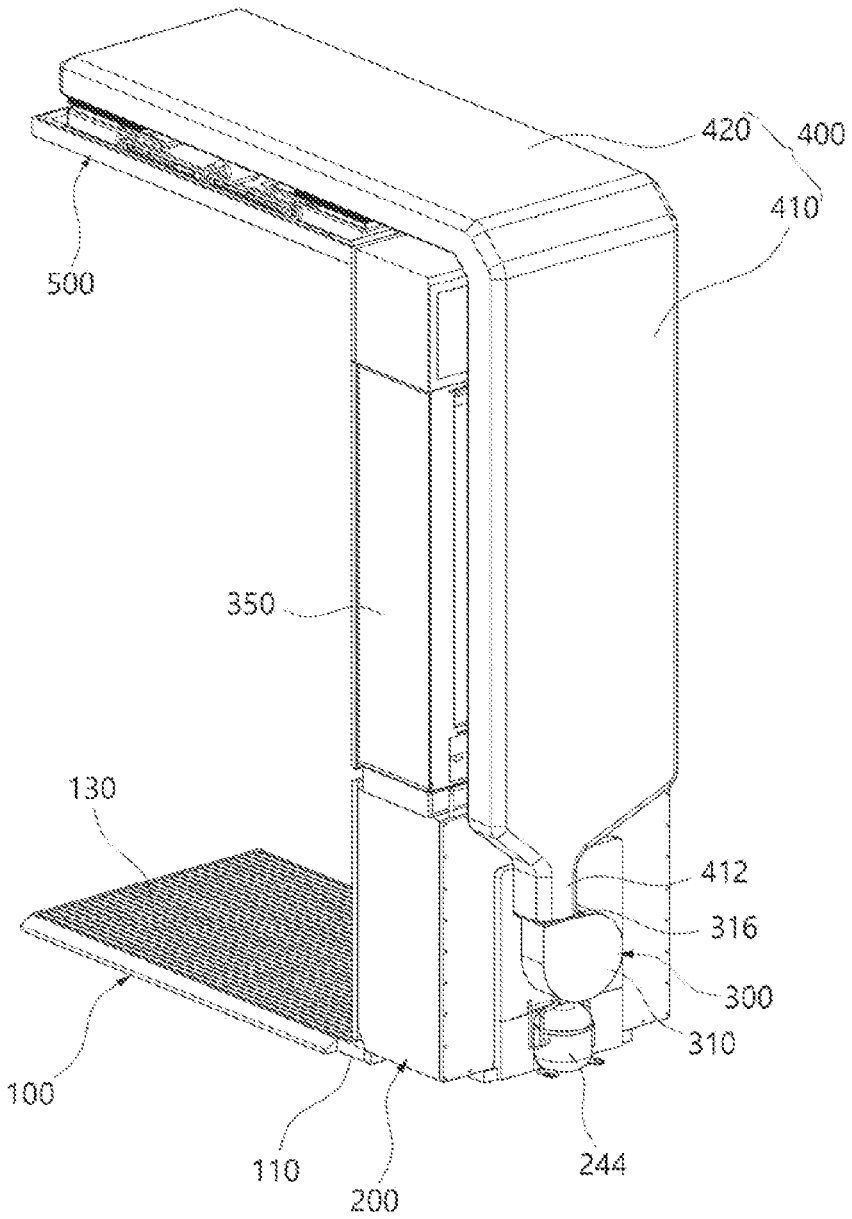
FIG. 2 is a rear perspective view illustrating the configuration of the hygiene management device according to an embodiment of the present invention.
Figure 3:
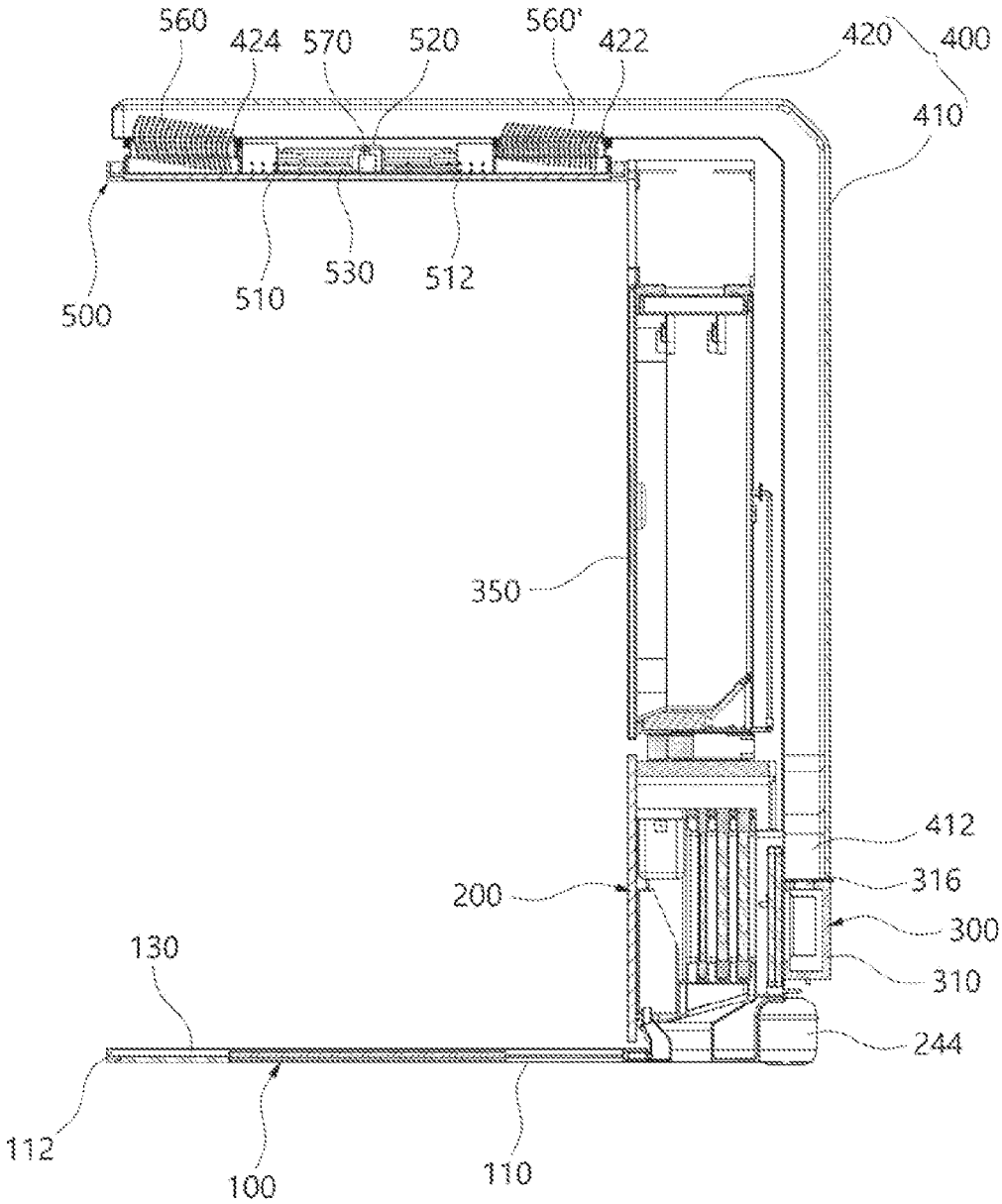
FIG. 3 is a sectional view approximately illustrating the configuration of the hygiene management device according to an embodiment of the present invention.
Figure 4:
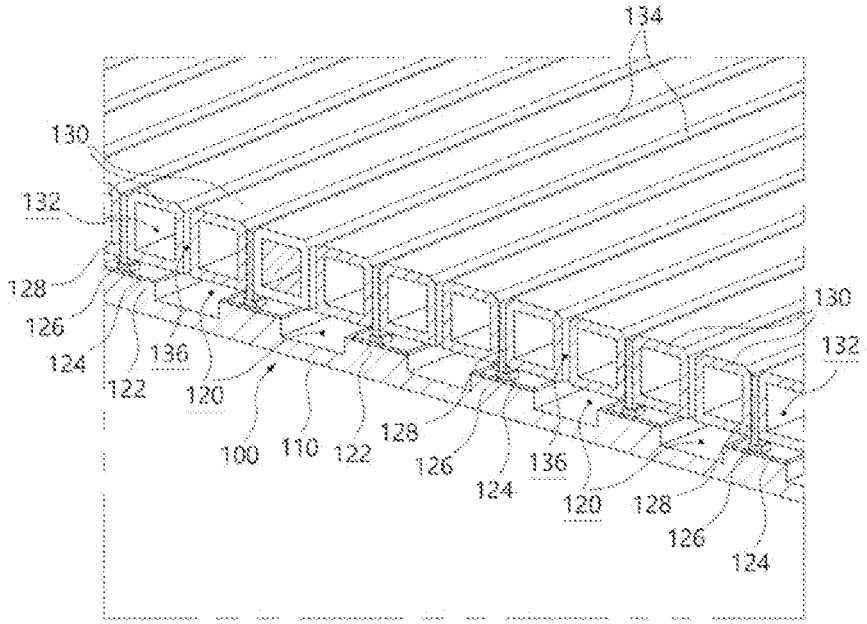
FIG. 4 is a sectional perspective view illustrating the configuration of footrest constituting the hygiene management device according to an embodiment of the present invention.

In the vane 560 or 560', at least a portion of the upper flow part 561 may be located inside the second duct 420. The lower flow part 561' of the vane 560 or 560' may be located mainly inside the vane frame 552 (i.e., substantially inside the vane frame 552). The upper flow part 561 of the vane 560 or 560' may have a larger portion located in the second duct 420 gradually in the flowing direction of air in the second duct 420. That is, the start part of the upper flow part 561 of the vane 560 or 560' may be located at a position of getting higher gradually in the flowing direction of air in the second duct 420. That is, the vanes 560 or 560' may extend progressively closer to the second duct 420 (or further from the vane rotation center member 558) in the flowing direction of the air in the second duct 420, as shown in and (b) of FIG. 16. Such a configuration is shown by comparing the vanes 560 provided in the first outlet 422 and the second outlet 424 in the figures. That is, the start part of the upper flow part 561 of the vane 560 provided in the second outlet 424 may be located at a position higher than the start part of the upper flow part 561 of the vane 560' provided in the first outlet 422. Such configuration can be seen even in FIG. 3. This is intended to allow air flowing in the second duct 420 to evenly flow through the entire portion of each of the first outlet 422 and the second outlet 424.

In addition, as for a length between the upper flow part 561 of the vane 560 or 560' and the lower flow part 561' thereof, a length between the upper flow part 561 and the lower flow part 561' of the vane 560' located at the first outlet 422 may be longer than a length between the upper flow part 561 and the lower flow part 561' of the vane 560 located in the second outlet 424. This is intended to allow much air to flow to the discharge hole 518 without air being wasted gradually toward the end of the second duct 420.

While being located in the vane frame 552, the lower flow part 561' of the vane 560 or 560' may guide air to the lower portion of the air discharger 500. According to the rotated state of the vane 560 or 560' relative to the vane rotation center member 558, a direction in which the lower flow part 561' guides air may be changed.

A vane drive member 562 may be provided to control the operation state of each of the vanes 560 and 560'. Like the vane rotation center member 558, the vane drive member 562 may be connected to each of the vanes 560 and 560'. The vane drive member 562 may be rotatably connected relative to each of the vanes 560 and 560' at a position located apart toward the discharge hole 518 from a portion at which the vane rotation center member 558 is connected to each of the vanes 560 and 560'. The vane drive member 562 may be connected mainly (or directly or completely) to the lower flow part 561' of the vane 560 or 560'. One vane drive member 562 may be used for each of the opposite sides of the vane 560 or 560'. Alternatively, only one vane drive member 562 may be used for the vane 560 or 560'.

The vane drive member 562 may be located inside the vane frame 552. A moving slot 564 may be formed in the vane frame 552 such that a portion of the vane drive member 562 is exposed to outside of the vane frame 552. The moving slot 564 may be formed to be open to each of the opposite outer surfaces of the vane frame 552. A connection pin 566 may be located in the moving slot 564. The first end part of the connection pin 566 may be connected to the vane drive member 562. The second end part of the connection pin 566 may be connected to a drive link 574 to be described later. A roller 568 may be located to surround a part of the length section of the connection pin 566. The roller 568 may enable the connection pin 566 to smoothly move in the moving slot 564.

A vane motor 570 may be mounted to the mounting plate 512 so as to drive the vane 560 or 560'. A motor gear 570' may be installed on the rotating shaft of the vane motor 570. A first drive gear 571 and a second drive gear 572 engaging with the motor gear 570' may be provided. The first drive gear 571 may supply a driving force to the vane 560' for the operation of the vane 560' installed in the first outlet 422, and the second drive gear 572 may supply a driving force to the vane 560 for the operation of the vane 560 installed in the second outlet 424.

The first drive gear 571 and the second drive gear 572 may drive the drive links 574, respectively. To this end, a rack part 576 may be provided in each of the drive links 574. A connection part 578 may be provided by extending to the opposite sides of the rack part 576 from a side thereof, and a drive part 580 may extend orthogonally to each of the opposite sides of the connection part 578 (i.e., two drive parts 580 may be provided at opposing ends of the connection part 578 and extending from the opposing ends of the connection part 578 in a direction orthogonal to an extension direction of the connection part 578). The connection pin 566 moving along the moving slot 564 formed in the vane frame 552 may be mounted to the drive part 580.

The drive link 574 may be composed of the rack part 576, the connection part 578, and the drive part 580, which are continuously connected to each other, which may cause sagging of the drive link 574. In the embodiment, to prevent the sagging of the drive link 574, a support 582 supporting the drive part 580 relative to the mounting plate 512 may be provided. The support 582 may include two supports used for one drive link 574, such that the supports 582 can support the drive parts 580 located at the opposite sides of the connection part 578. Reference numeral 584 is a stopper that sets one end of the travel stroke of the drive link 574.

For reference, to avoid the interference of the vane motor 570 with the connection link 545 and the second mounting piece 549, the length of the rack part 576 of the drive link 574 or the connection position of the vane motor 570 with the connection part 578 may be changed unlike the illustration of the drawing.

Hereinafter, the operation of the hygiene management device of the present disclosure having the configuration described above will be described in detail.

Referring to FIGS. 17 to 22, the operation of the hygiene management device will be described. For a person to enter the entrance space 10 in which the hygiene management device of the present disclosure is installed, the outside door 12 is opened. When detecting the opening of the outside door 12, the air discharger 500 may discharge air toward the outside door 12 to prevent external air from being introduced into the entrance space 10. To this end, as illustrated in FIG. 18, the lower surface of the air discharger 500 may be directed to be inclined toward the outside door 12.

That is, the part (i.e., a first part) of the discharger frame 510 at a side at which the first lift 520 is located may be relatively low (compared to a second part of the discharge frame 510 located adjacent to the second lift 520'), and the part of the discharger frame 510 at a side at which the second lift 520' is located may be relatively high. To this end, the drive motor 524 may be driven such that a driving force is transmitted through the driving gear 526, the following gear 528, and the first interlocking gear 532 to the drive member 536. While the second interlocking gear 532' is rotated by the operation of the drive member 536, the pinion gear 538 rotated integrally with the second interlocking gear 532' may rotate by engaging with the rack gear 543 of the rack guide 540 and may move along the rack slot 542. Due to the movement of the pinion gear 538 along the rack slot 542, the second interlocking gear 532' may also move and thus the angle of the casing 534 may be changed.

When the casing 534 is positioned to be parallel to the discharger frame 510 ((a) of FIG. 20), the discharger frame 510 at the associated position may be relatively close to the duct 400. Contrarily, when an angle defined between the casing 534 and the discharger frame 510 increases ((b) of FIG. 20), the discharger frame 510 at the associated position may move away from the duct 400. That is, the height of the associated part of the discharger frame 510 may become low.

In the state shown in FIG. 18, the height of the discharger frame 510 at a side at which the first lift 520 is located becomes low (compared to the height of the discharger frame 510 at a side at which the second lift 520' is located), and the height of the discharger frame 510 at a side at which the second lift 520' is located becomes relatively high. In this case, the air discharger 500 may discharge air in a downward slanting direction toward the outside door 12.

Contrarily, as illustrated in FIG. 19, when the height of the discharger frame 510 at a side at which the first lift 520 is located becomes relatively high and the height of the discharger frame 510 at which the second lift 520' is located becomes relatively low, the air discharger 500 may discharge air in a downward slanting direction toward the inside door 14.

Even when the lifts 1520 and 1520', and 2520 and 2520' of the embodiments illustrated in FIGS. 12 and 14, respectively, are used, the height of the discharger frame 510 may be adjusted in the same method as the method described above. That is, the inclination of the discharger frame 510 may be adjusted by winding/unwinding the wire 1528 on/from the bobbin 1526 and by moving the lift rod in/out of the cylinder 2526, respectively.

Meanwhile, when a person enters the entrance space 10 by opening the outside door 12, then the person closes the outside door 12, and is then located on the footrest 100 as illustrated in FIG. 17, first, the fan assembly 300 may operate such that the air of the entrance space 10 is introduced into the footrest 100.

The footrest 100 may allow air to be introduced thereto through the introduction area 118. Air may be introduced into the introduction flow path 120 of the introduction area 118 covered by the support bars 130. Air may be introduced into the introduction flow path 120 through the introduction slot 136 formed between the support bars 130.

The introduction slot 136 formed between the support bars 130 may have a relatively narrow flow cross-section, so air may be introduced to the introduction slot 136 with a relatively strong introduction force such that the air flows to the introduction flow path 110.

Although the support bar 130 is empty therein and is relatively light in weight, the support bar may properly support the weight of a person. At the same time, the introduction slot 136 formed between the support bars 130 may function as a kind of filter such that foreign matter having at least a predetermined size is prevented from being introduced into the introduction flow path 120.

Meanwhile, ultraviolet light for sterilization emitted from the light source 126 may be emitted to the upper side of the footrest 100 through the light transmission member 128 located between the support bars 130. The ultraviolet light emitted through the light transmission member 128 may be emitted intensively on and sterilize the shoes and lower body of a person.

Air transferred to the introduction flow path 120 may be introduced into the air management module 200. The air may be introduced into the air management module 200 through the fixed connection duct 234 communicating with the introduction flow path 120. Air introduced to the fixed connection duct 234 may be introduced into the communication path 218 through the rotating connection duct 236 and the movable duct 238.

While air is passing through the communication path 218, the moisture removal, dust removal and sterilization of the air may be performed by the first filter 221, the second fitter 223, and the third filter 225, respectively. The temperature of air may have a preset value while the air is passing through the heat exchanger 240 or heater.

Air passing through the communication path 218 may be introduced into the fan assembly 300. The air introduced into the fan assembly 300 may be flown by the fan 318 and then may be introduced into the duct 400. Some of the air introduced to the duct 400 may be selectively transferred to the function module 350 to be used.

Air transferred to the first duct 410 of the duct 400 may flow to the second duct 420 and may be transferred sequentially to the first outlet 422 and the second outlet 424 of the second duct 420. The vanes 560' and 560 may be located in the first outlet 422 and the second outlet 424, respectively, and the flowing air may be guided by the vane 560' and 560 to be introduced to the first outlet 422 and the second outlet 424, respectively. In addition, the multiple vanes 560' and 560 may be provided in the first outlet 422 and the second outlet 424, respectively, such that the vanes have predetermined height differences and intervals therebetween, so air may relatively evenly spread and flow even inside the first outlet 422 and the second outlet 424. This state is illustrated in FIG. 21. In FIG. 21, it is illustrated that air is guided by the vanes 560 and 560' and is discharged to be inclined toward the center portion of the footrest 100 through the discharge holes 518.

For the operation of the vane 560 or 560', the drive link 574 may be rectilinearly reciprocated by the vane motor 570. While the vane drive member 562 is moved by the rectilinear reciprocation of the drive link 574, the vane 560 or 560' may be rotated at a predetermined angle relative to the vane rotation center member 558. Due to such rotation of the vane 560 or 560' at a predetermined angle, a direction to which the lower flow part 561' of the vane 560 or 560' is directed may be adjusted such that the direction of air discharged through the discharge hole 518 is changed.

The vanes 560' located in the first outlet 422 and the vanes 560 located in the second outlet 424 may be pulled in directions toward the vane motor 570 or pushed in directions away from the vane motor 570 by the drive links 574, respectively, due to the unidirectional rotation of the vane motor 570.

In (a) of FIG. 22 a state in which the drive links 574 are pulled in the directions toward the vane motor 570 is illustrated. In this case, the lower flow part 561' of each of the vanes 560 and 560' may be located to be inclined toward the center of the air discharger 500. In this state, air may be guided along the lower flow part 561' of the vane 560 and may be discharged toward the center of the lower side of the air discharger 500. This is the case for both the discharge hole 518 corresponding to the first outlet 422 and the discharge hole 518 corresponding to the second outlet 424. Accordingly, air discharged through two discharge holes 518 may be collected relatively toward the center of the footrest 100.

In addition, it can be seen that all of the upper flow parts 561 are directed to the relatively upstream of the second duct 420, and the upper flow parts 561 protrude more to the inside of the second duct 420 gradually toward the downstream of the second duct 420.

In (b) of FIG. 22, a state in which the drive link. 574 is moved in a direction away from the vane motor 570 is illustrated. In this case, the lower flow part 561' of the vane 560 or 560' may be disposed toward a relatively lower part such that air can be discharged to the lower side of the air discharger 500. Accordingly, air discharged through two discharge holes 518 may be spread and transferred toward the entirety of the upper portion of the footrest 100.

In the above, even though all components constituting the hygiene management device according to the embodiment of the present disclosure are described as being combined or operated in combination as one component, the present disclosure is not necessarily limited to this embodiment. That is, within the scope of the present disclosure, at least two of all the components may be selectively combined with each other to be operated. In addition, terms such as "include", "be composed of", or "have" described above mean that the corresponding component may be inherent unless otherwise stated, so the terms should not be construed as excluding other components, but may further include other components.

In the illustrated embodiments, the first lift 520, 1520, or 2520 and the second lift 520', 1520', or 2520' are located at the opposite edges of the discharger frame 510, respectively, to adjust the angle of the air discharger 500. However, each of the lifts 520, 1520, or 2520 and 520', 1520', or 2520' may include multiple lifts having the same configurations so as to adjust the angle of the air discharger 500. For example, lifts may be located at positions adjacent to the four edges of the discharger frame 510.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hygiene management device comprising:

a footrest located at a bottom side of an entrance space to pass air through a surface of the footrest;

an air management module configured to receive the air passed through the footrest and to manage quality of the passing air;

a fan assembly configured to receive the air from the air management module and to generate a flow of the air;

a duct constituting a path of the air flow generated by operation of the fan assembly; and an air discharger including an air guide unit and a discharge hole and configured to receive the air flowing through the duct and to discharge the air through the discharge hole towards the surface of the footrest within a predetermined angle range in an entering/exiting direction of a person, the air guide unit including:

a vane frame communicating the duct with the discharge hole;

a plurality of vanes positioned adjacent to one another in the vane frame and configured to be rotatable to guide air; and a vane motor configured to supply a driving force to rotate the plurality of vanes, wherein each of the plurality of vanes includes an upper flow part configured to receive air from the duct and to guide the air, a lower flow part configured to discharge the guided air, and a connection curved part connecting the upper flow part with the lower flow part, wherein each upper flow part at least partially extends into an inside of the duct, and wherein the upper flow parts of the vanes extend further into the duct the further downstream each respective vane is in relation to a flowing direction of the air in the duct.

2. The hygiene management device of claim 1, wherein the air guide unit further includes:

a vane drive member connected to the plurality of vanes; and a drive link configured to operate the vane drive member by the driving force of the vane motor to cause a rotation of the plurality of vanes.

3. The hygiene management device of claim 2, wherein the vane drive member and the drive link are connected to each other by a connection pin passing through a moving slot formed in the vane frame such that the driving force of the vane motor is transmitted between the vane drive member and the drive link.

4. The hygiene management device of claim 3, further comprising a roller rotatably mounted to the connection pin, wherein the connection pin moves in the moving slot via the roller.

5. The hygiene management device of claim 1, wherein each upper flow part is inclined toward an upstream portion of the duct and is positioned inside of the duct, and wherein each lower flow part is inclined toward a center portion of the footrest.

6. The hygiene management device of claim 5, wherein vanes, among the plurality of vanes, positioned in a downstream portion of the duct, are longer than vanes, among the plurality of vanes, positioned in the upstream portion of the duct, a length of the vanes being defined between a start point of the upper flow part of each vane and an end point of the lower flow part of each vane.

7. The hygiene management device of claim 6, wherein virtual extension surfaces of the upper flow parts of the plurality of vanes are parallel to each other, and wherein virtual extension surfaces of the lower flow parts of the plurality of vanes are parallel to each other.

8. The hygiene management device of claim 6, wherein virtual extension surfaces of the upper flow parts of the plurality of vanes form an obtuse angle with virtual extension surfaces of the lower flow parts of the plurality of vanes.

9. The hygiene management device of claim 1, wherein the duct includes:

a first duct extending vertically along a side surface of the hygiene management device and communicating with the fan assembly; and a second duct extending from the first duct, extending horizontally and defining a top surface of the hygiene management device, and wherein a first outlet is formed in an upstream portion of the second duct, and a second outlet is formed in a downstream portion of the second duct.

10. The hygiene management device of claim 9, wherein a corrugated pipe is installed at each of a position between the first outlet and the vane frame and a position between the second outlet and the vane frame so as to prevent leakage of air.

11. A hygiene management device comprising:

a fan assembly configured to generate a flow of air, a duct constituting a path of the air flow generated by operation of the fan assembly; and an air discharger including at least one air guide unit and a discharge hole and configured to receive the air flowing through the duct and to discharge the air through the discharge hole within a predetermined angle range in an entering/exiting direction of a person entering/exiting the hygiene management device, the at least one air guide unit including:

a vane frame communicating the duct with the discharge hole;

a plurality of vanes positioned adjacent to one another in the vane frame and configured to be rotatable to guide air; and a vane motor configured to supply a driving force to rotate the plurality of vanes, wherein each of the plurality of vanes includes an upper flow part configured to receive air from the duct and to guide the air, a lower flow part configured to discharge the guided air, and a connection curved part connecting the upper flow part with the lower flow part, wherein each upper flow part at least partially extends into an inside of the duct, and wherein the upper flow parts of the vanes extend further into the duct the further downstream each respective vane is in relation to a flowing direction of the air in the duct.

12. The hygiene management device of claim 11, wherein the at least one air guide unit includes a first air guide unit and a second air guide unit, and wherein the first air guide unit is spaced apart from the second air guide unit in a longitudinal direction of the air discharger.

13. The hygiene management device of claim 12, wherein each vane motor is connected to a respective one of the first air guide unit and the second air guide unit via a respective link to simultaneously drive a rotation of the plurality of vanes of a respective one of the first air guide unit and the second air guide unit.

14. The hygiene management device of claim 13, wherein each vane frame includes two moving slots provided at opposing sides of the vane frame, and wherein each of the first air guide unit and the second air guide unit further includes two drive parts, each drive part having a connection pin that moves within a respective one of the two respective moving slots to move the respective plurality of vanes of the respective air guide unit.

15. The hygiene management device of claim 11, wherein the air discharger further includes:

a first lift positioned at a first side of the air discharger; and a second lift positioned at a second side of the air discharger opposite to the first side of the air discharger and spaced from the first lift, and wherein the first lift and the second lift of the air discharger are configured to move to adjust a direction of air flowing out of the air discharger.

16. A hygiene management device comprising:

a footrest located at a bottom side of an entrance space to pass air through a surface of the footrest;

an air management module configured to receive the air passed through the footrest and to manage quality of the passing air;

a fan assembly configured to receive the air from the air management module and to generate a flow of the air;

a duct constituting a path of the air flow generated by operation of the fan assembly; and an air discharger including an air guide unit and a discharge hole and configured to receive the air flowing through the duct and to discharge the air through the discharge hole towards the surface of the footrest within a predetermined angle range in an entering/exiting direction of a person, the air guide unit including:

a vane frame communicating the duct with the discharge hole;

a plurality of vanes positioned adjacent to one another in the vane frame and configured to be rotatable to guide air; and a vane motor configured to supply a driving force to rotate the plurality of vanes, wherein the duct includes:

a first duct extending vertically along a side surface of the hygiene management device and communicating with the fan assembly; and a second duct extending from the first duct, extending horizontally and defining a top surface of the hygiene management device, wherein a first outlet is formed in an upstream portion of the second duct, and a second outlet is formed in a downstream portion of the second duct, and wherein a corrugated pipe is installed at each of a position between the first outlet and the vane frame and a position between the second outlet and the vane frame so as to prevent leakage of air.

* * * * *